US008614722B2

(12) United States Patent
Ozaki

(10) Patent No.: US 8,614,722 B2
(45) Date of Patent: Dec. 24, 2013

(54) DISPLAY DEVICE AND DRIVING METHOD OF THE SAME

(75) Inventor: Tadafumi Ozaki, Gifu (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 1676 days.

(21) Appl. No.: 11/293,383

(22) Filed: Dec. 2, 2005

(65) Prior Publication Data

US 2006/0181490 A1 Aug. 17, 2006

(30) Foreign Application Priority Data

Dec. 6, 2004 (JP) ..... 2004-353413

(51) Int. Cl.
*G09G 5/10* (2006.01)
*G09G 5/00* (2006.01)

(52) U.S. Cl.
USPC ..... 345/691; 345/692; 345/204

(58) Field of Classification Search
USPC ..... 345/76–83, 87–104, 204–215, 690–699
See application file for complete search history.

(56) References Cited

U.S. PATENT DOCUMENTS 6,476,781 B1 * 11/2002 Suzuki et al. ..... 345/60
6,552,736 B2 * 4/2003 Honda et al. ..... 345/691
6,747,616 B2 6/2004 Honda et al.
6,815,901 B2 11/2004 Koyama
7,116,057 B2 10/2006 Koyama
7,233,300 B2 6/2007 Kwon et al.
7,283,111 B2 10/2007 Kimura
7,330,179 B2 2/2008 Endo et al.
7,888,878 B2 2/2011 Koyama
8,022,633 B2 9/2011 Koyama
8,373,625 B2 2/2013 Kimura
2001/0022565 A1 * 9/2001 Kimura ..... 345/82
2002/0030672 A1 3/2002 Honda et al.
2002/0047852 A1 4/2002 Inukai et al. ..... 345/629
2003/0006952 A1 1/2003 Hong
2003/0174153 A1 9/2003 Koyama ..... 345/690

(Continued)

FOREIGN PATENT DOCUMENTS

CN 2004-177563 A 2/2003
CN 1405748 A 3/2003

(Continued)

OTHER PUBLICATIONS

Office Action re Chinese application No. CN 200510129090.5, dated Jun. 27, 2008 (with English translation).

(Continued)

*Primary Examiner* — Kenneth Bukowski
(74) *Attorney, Agent, or Firm* — Husch Blackwell LLP

(57) ABSTRACT

In a display using a time gradation method, as the number of the subframes in one frame period increases, the number of writings of video data to a pixel and the operating quantity of a driver circuit of the display increase so that power consumption increases. In a display device of the invention, one frame period is divided into n subframe periods using a display controller, the subframe periods are made to emit light or not, to express m-bit gradation by the total sum of lighting time in one frame period, and the number of subframe periods n provided in one frame period and the number of gradations m capable of being expressed are changed corresponding to each row arranged in matrix.

17 Claims, 27 Drawing Sheets

(56) References Cited

U.S. PATENT DOCUMENTS

| | | | | |
|---|---|---|---|---|
| 2004/0090404 | A1* | 5/2004 | Endo et al. | 345/82 |
| 2004/0095364 | A1 | 5/2004 | Koyama et al. | 345/690 |
| 2008/0174579 | A1 | 7/2008 | Endo et al. | |

FOREIGN PATENT DOCUMENTS

| | | | |
|---|---|---|---|
| CN | 1409285 | A | 4/2003 |
| CN | 1501698 | A | 6/2004 |
| CN | 1705971 | | 12/2005 |
| JP | 2000-194305 | | 7/2000 |
| JP | 2001-306019 | | 11/2001 |
| JP | 2001-306020 | | 11/2001 |
| JP | 2002-149113 | | 5/2002 |
| JP | 2003-271099 | | 9/2003 |
| JP | 2004-163774 | | 6/2004 |
| JP | 2004-163777 | | 6/2004 |
| JP | 2004-163919 | | 6/2004 |
| JP | 2004-177563 | | 6/2004 |
| JP | 2004-191700 | | 7/2004 |
| WO | WO 2004/036534 | A1 | 4/2004 |

OTHER PUBLICATIONS

Shimoda, T. et al, "Current Status and Future of Light-Emitting Polymer Display Driven by Poly-Si TFT," SID 99 Digest, pp. 372-375 (1999).

Office Action re Chinese application No. CN 200910128570.8, dated Feb. 27, 2012 (with English translation).

* cited by examiner subframe period SF
SF1
SF2
SF3
SF4
writing period Ta
display period Ts
Ta1
Ts1
Ta2
Ts2
Ta3
Ts3
Ta4
Ts4 subframe period SF
SF1
writing period Ta
display period Ts
Ta1
Ts1 subframe period SF
SF1
SF2
writing period Ta
display period Ts
Ta1
Ts1
Ta2
Ts2
701
702
703
704
frame period F
F1

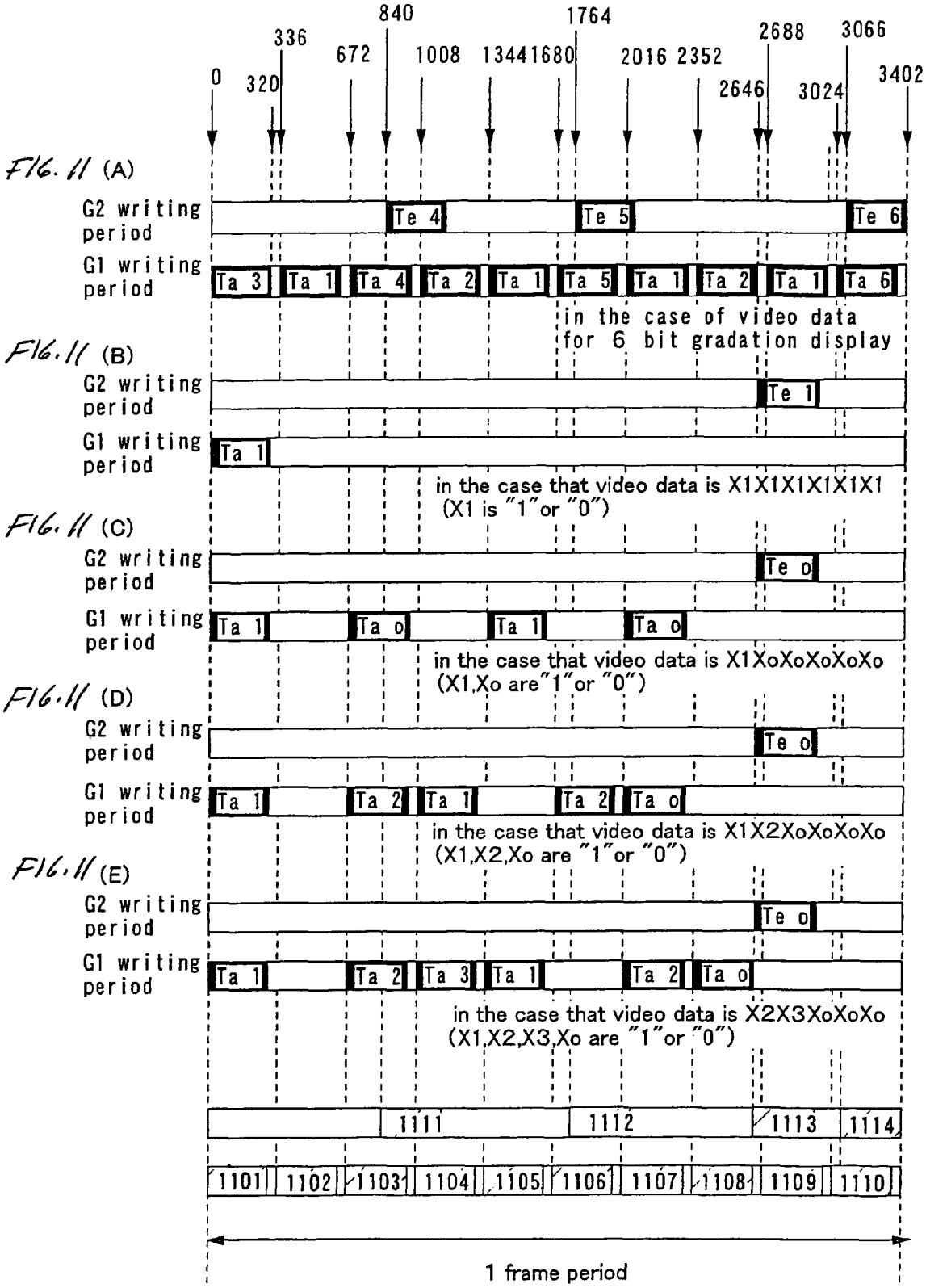
0
320
336
672
840
1008
1344
1680
1764
2016
2352
2646
2688
3024
3066
3402
FIG. 11 (A)
G2 writing period
Te 4
Te 5
Te 6
G1 writing period
Ta 3
Ta 1
Ta 4
Ta 2
Ta 1
Ta 5
Ta 1
Ta 2
Ta 1
Ta 6
in the case of video data for 6 bit gradation display
FIG. 11 (B)
G2 writing period
Te 1
G1 writing period
Ta 1
in the case that video data is X1X1X1X1X1X1 (X1 is "1" or "0")
FIG. 11 (C)
G2 writing period
Te o
G1 writing period
Ta 1
Ta o
Ta 1
Ta o
in the case that video data is X1XoXoXoXoXo (X1,Xo are "1" or "0")
FIG. 11 (D)
G2 writing period
Te o
G1 writing period
Ta 1
Ta 2
Ta 1
Ta 2
Ta o
in the case that video data is X1X2XoXoXoXo (X1,X2,Xo are "1" or "0")
FIG. 11 (E)
G2 writing period
Te o
G1 writing period
Ta 1
Ta 2
Ta 3
Ta 1
Ta 2
Ta o
in the case that video data is X2X3XoXoXo (X1,X2,X3,Xo are "1" or "0")
1111
1112
1113
1114
1101
1102
1103
1104
1105
1106
1107
1108
1109
1110
1 frame period

DISPLAY DEVICE AND DRIVING METHOD OF THE SAME

FIELD OF THE INVENTION

The present invention relates to a display device in which a digital video signal is inputted and image display is performed. Particularly, the invention relates to a display device having a light-emitting element. In addition, the invention relates to an electronic apparatus using the display device.

BACKGROUND OF THE INVENTION

One of the driving methods of a light-emitting device is a time gradation method which controls a length in which a pixel emits light in one frame period using a binary voltages that digital video signals (hereinafter referred to video data) have to display gradation. Specifically, in the case where display is performed by a time gradation method, one frame period is divided into a plurality of subframe periods. Then, in accordance with a value of one bit (hereinafter referred to as a video bit) among a plurality of video data bits, a pixel is to be a state of light emission or non-light emission in each subframe period. The length of light emission and non-light emission is different between video bits, and a most significant video bit is the longest and a least significant video bit is the shortest.

One example of a conventional time gradation display device is described with reference to FIG. 1. A pixel portion 107 is arranged centrally. In the pixel portion, a current supply line 106 for supplying a current to an EL element (means a light-emitting element using an electroluminescence material) is arranged as well as a source signal line and a gate signal line. Above the pixel portion, a source driver circuit 101 for controlling the source signal line is arranged. The source driver circuit 101 has a first shift register circuit 103, a first latch circuit 104, a second latch circuit 105 and the like. On the left of the pixel portion, a gate driver circuit 102 for controlling the gate signal line is arranged.

As for the source driver circuit 101, a configuration as shown in FIG. 2 is provided, and a shift register circuit (SR) 201, a first latch circuit (LAT1) 202, a second latch circuit (LAT2) 203 and the like are provided. Note that although not shown in FIG. 1 and FIG. 2, a buffer circuit, a level shifter circuit or the like may be arranged if necessary.

An operation is briefly described with reference to FIGS. 1 and 2. First, a clock signal (referred to as S-CLK and S-CLKb in FIG. 2) and a start pulse (referred to as S-SP in FIG. 2) are inputted to the first shift register circuit 103 (referred to as SR in FIG. 2), and sampling pulses are outputted sequentially. Subsequently, the sampling pulses are inputted to the first latch circuit 104 (referred to as LAT1 in FIG. 2), and video data (referred to as Digital Data in FIG. 2) similarly inputted to the first latch circuit 104 are held. In the first latch circuit 104, in one horizontal period, when holding of each digital video signal for one bit by each latch is completed, the digital video signals held in the first latch circuit 104 are transferred to the second latch circuit 105 (referred to as LAT2 in FIG. 2) all at once in accordance with an input of a latch signal (referred to as Latch Pulse in FIG. 2) during a fly-back period.

On the other hand, in the gate driver circuit 102, a gate side clock signal (G-CLK) and a gate side start pulse (G-SP) are inputted to a second shift register circuit 108. The second shift register circuit 108 outputs pulses sequentially based on these input signals and through a buffer (not shown) or the like, outputted as a gate signal line selection pulse to select a gate signal line sequentially.

Data transferred to the second latch circuit 105 in the source driver circuit 101 is written in pixels of a column selected by the gate signal line selection pulse.

Subsequently, the drive of the pixel portion 107 is described. FIG. 3 shows a part of the pixel portion 107 of FIG. 1. FIG. 3 (A) shows a matrix of 3×2 pixels. A portion surrounded by a doted line frame 300 is one pixel and its enlarged view is shown in FIG. 3 (B). Reference numeral 301 is a TFT (hereinafter referred to as a switching TFT) which functions as a switching element when a signal is written in the pixel in FIG. 3 (B).

Either polarity of an N channel type or a P channel type may be used for the switching TFT 301. Reference numeral 302 is a TFT (referred to as an EL driver TFT) which functions as an element (a current control element) for controlling a current supplied to an EL element 303. In the case where a P channel type is used for the EL driving TFT 302, the EL driving TFT 302 is arranged between an anode 309 of the EL element 303 and a current supply line 307. As another structure method, an N channel type can be used for the EL driving TFT 302 and the EL driving TFT 302 can be arranged between a cathode 310 of the EL element 303 and the current supply line 307 as well. However, since a grounded source is preferable for a TFT operation, the restriction in manufacture of the EL element 303 or the like, a method is common and often adopted in which a P channel type is used for the EL driving TFT 302 and the EL driving TFT 302 is arranged between the anode 309 of the EL element 303 and the current supply line 307.

A storage capacitor 304 is to hold a signal (voltage) inputted from a source signal line 306. Although one terminal of the storage capacitor 304 in FIG. 3 (B) is connected to the current supply line 307, a dedicated wire may also be used. A gate electrode of the switching TFT 301 is connected to a gate signal line 305 and a source region thereof is connected to the source signal line 306.

Next, with reference to FIG. 3, description is made on a circuit operation of an active matrix type light-emitting device. First, when the gate signal line 305 is selected, a voltage is applied to the gate electrode of the switching TFT 301 and the switching TFT 301 becomes a conductive state. Then, a signal (voltage) of the source signal line 306 is stored in the storage capacitor 304. Since the voltage of the storage capacitor 304 is a gate-source voltage $V_{GS}$ of the EL driving TFT 302, a current corresponding to the voltage of the storage capacitor 304 flows to the EL driving TFT 302 and the EL element 303. As a result, the EL element 303 emits light.

Luminance of the EL element 303, that is, the amount of the current flowing to the EL element 303 can be controlled by $V_{GS}$ of the EL driving TFT 302. $V_{GS}$ is equivalent to the voltage of the storage capacitor 304. That is, by controlling a signal (voltage) inputted to the source signal line 306, luminance of the EL element 303 is controlled. Finally, the gate signal line 305 is made into a non-selection state, the gate of the switching TFT 301 is closed, and the switching TFT 301 is made into a non-conductive state. At this time, a charge stored in the storage capacitor 304 is held. Therefore, $V_{GS}$ of the EL driving TFT 302 is held and a current corresponding to $V_{GS}$ continues flowing to the EL element 303 through the EL driving TFT 302.

The aforementioned drive of the EL element or the like has been reported in the following Non-Patent Document 1.

In a first display mode displaying images of $2^4$ gradations by a time gradation display method, one frame period is divided into four subframe periods as shown in FIG. 4 (A) to display. In addition, in a second display mode displaying images of 2 gradations by a time gradation display method, one subframe period is included in one frame period as shown in FIG. 4 (B).

Display may be performed by changing a display control signal such that a whole surface is displayed by the first display mode in a certain frame period, using the subframe structure shown in FIG. 4 (A) whereas the whole surface is displayed by the second display mode in another frame period using the subframe structure shown in an indicator diagram 4 (B).

The aforementioned display driving methods are described in the following Patent Document 1 to Patent Document 3.

When displayed by using a time gradation method, a pseudo contour becomes a problem. In a pseudo contour, there are a moving image pseudo contour generated when a moving image is displayed and a still image pseudo contour generated when a still image is displayed. In frame periods appearing continuously, a moving image pseudo contour is generated by that a subframe period included in the preceding frame period and a subframe period included in a subsequent frame period are recognized as one sequential frame period by human eyes. That is, the moving image pseudo contour corresponds to an unnatural bright line or a dark line which is displayed on a pixel portion due to that the number of gradations which is different from the number of gradations which should be displayed in the normal frame period is recognized by human eyes.

Mechanism of generating a still image pseudo contour is similar to the case of the moving image pseudo contour. In the case of displaying a still image, a still image pseudo contour is generated by that a moving image seems to be displayed in a pixel in a vicinity of a boundary due to that visual points by humans are slightly moved left and right, and up and down in boundaries of regions in which the number of gradations are different from each other. That is, the still image pseudo contour corresponds to an unnatural bright line or a dark line which is generated so as to swing in the vicinity of a boundary due to that a moving image pseudo contour is generated in a pixel near the vicinity of a boundary of regions which have different numbers of gradations.

In order to prevent the aforementioned pseudo contour, it is effective to increase frame frequency, to further divide a subframe period into a plurality of numbers, or the like. The following Patent Document 4 describes a technique in which a subframe period is divided into a plurality of numbers and a period when a pixel emits light or a period when a pixel emits no light is prevented from continuing.

Although description is made using a P channel type for the EL driving TFT 302 in this specification, actually, a configuration using an N channel type may be used as well. In addition, $V_{GS}$ of the storage capacitor 304 is controlled using a binary voltage value by a time gradation method, and when the higher one of the binary is expressed by "1" and the lower one is expressed by "0", in the case where a potential of the storage capacitor is "1", a portion between the source and the drain of the EL driving TFT 302 becomes non-conductive and the EL element 303 emits no light whereas in the case where the potential of the storage capacitor is "0", the portion between the source and drain of the EL driving TFT 302 becomes conductive and the EL element 303 emits light. In addition, in this specification, holding of "1" or "0" in the storage capacitor 304 is described as writing. Further, in a digital circuit which operates using a binary voltage value, the binary are expressed by "1" and "0". Note that in signals specifying the logic of "1" and "0" in this specification, logic may be inverted. Here, when the potential of one electrode of the storage capacitor is "1", the portion between the source and drain of the EL driving TFT 302 becomes conductive, while the potential of one electrode of the storage capacitor is "0", the portion between the source and drain of the EL driving TFT 302 becomes conductive. In addition, in this specification, pixels including a gate signal line and the switching TFT 301 connected to a gate may be expressed as a row. Moreover, in this specification, in a time gradation method which displays for one frame period using a plurality of subframes, a period from a writing of video data to a pixel to the next writing of video data is defined as a subframe. Further, in this specification, among video bits, the most significant bit is described as a first bit, and a bit which is r bit (r is a natural number) lower than the most significant bit is described as a (1+r) bit.

Patent Document 1—Japanese Patent Laid-Open No. 2003-271099

Patent Document 2—Japanese Patent Laid-Open No. 2004-163774

Patent Document 3—Japanese Patent Laid-Open No. 2004-163777

Patent Document 4—Japanese Patent Laid-Open No. 2002-149113

Non-Patent Document 1—"Current Status and future of Light-Emitting Polymer Display Driven by Poly-Si TFT", SID99 Digest: P372

In a display using a time gradation method, one frame period is divided into a plurality of subframes to display. Accordingly, as the number of the subframes in one frame period increases, the number of times for writing video data to a pixel and the operating quantity of a driver circuit of a display increase so that power consumption increases. On the other hand, in the case where the number of subframes is too small, the generation of the pseudo contour described in Background Art may be a problem.

SUMMARY OF THE INVENTION

In the display device of the invention, in the case where a plurality of subframes are used to express gradation in one frame period, the number of subframes and the number of gradations capable of displaying are changed per row by a condition such as the number of gradations to be displayed by video data which is inputted to each pixel for one row to display.

Note that the condition such as the number of gradations to be displayed by video data is a condition in that a plurality of video bits or one video bit is equivalent for all of video data written in each pixel for one row and the like. According to this method, the number of times for writing video data in one frame can be greatly reduced, power consumption can be improved, and a pseudo contour can be reduced by optimizing a structure method of subframes of each row.

The display device of the invention is characterized in that, in a display device having a display controller, a first means by which one frame period is divided into n (n is a natural number) subframe periods, the subframe periods are made to emit light or not, and a gradation with m bits (m is a natural number) in accordance with the total sum of lighting time in one frame period is expressed, and a second means which changes the number of n (n is a natural number) subframe periods which is provided in one frame period corresponding to each row arranged in matrix and the number of m (m is a natural number) gradations which can be expressed are included, in which a gradation is expressed using the first means, the number of n (n is a natural number) subframe periods and the number of m (m is a natural number) gradations which can be expressed are changed using the second means, and the first means and the second means are controlled using the display controller.

The display device of the invention is characterized in that the display controller has a first memory, and data of n (n is a natural number) bits is written and read to perform display in the first means.

The display device of the invention is characterized in that the display controller has a source driver circuit, and a first display control signal is produced and inputted to the source driver circuit to perform display in the first means.

The display device of the invention is characterized in that the display controller has a gate driver circuit, and a second display control signal is produced and inputted to the gate driver circuit to perform display in the first means.

The display device of the invention is characterized in that the number of n (n is a natural number) subframe periods and the number of m (m is a natural number) gradations which can be expressed are changed in accordance with video data in the second means.

The display device of the invention is characterized in that the display controller has a second memory, and subframe structure information of the number of n (n is a natural number) subframe periods and the number of m (m is a natural number) gradations which can be expressed is written and read in the second means. The subframe structure information is the number of subframes, length of each subframe, an order thereof and one or a plurality of gradations by them.

The display device of the invention is characterized in that an address to be read from the first memory is determined based on subframe structure information read from the second memory in the second means.

The display device of the invention is characterized in that whether a read operation is performed from the first memory or a read operation is not performed from the first memory is determined based on subframe structure information read from the second memory in the second means.

The display device of the invention is characterized in that a first display control signal is produced based on subframe structure information read from the second memory in the second means.

The display device of the invention is characterized in that a second display control signal is produced based on subframe structure information read from the second memory in the second means.

By the aforementioned structure, the invention can display a display changing a subframe structure in each row. Therefore, in a row where the number of gradations to be displayed actually is smaller than the number of all gradations which can be displayed, the number of subframes structuring one frame can be reduced.

Accordingly, in the display device of the invention, the number of writing times to a pixel can be reduced, power consumption can be suppressed, and a subframe structure can be changed in each row, thereby a subframe structure is optimized so that generation of a moving image pseudo contour can be suppressed.

BRIEF DESCRIPTION OF DRAWINGS

FIGS. 11(A)-11(E) are diagrams each of which shows one example of a subframe structure in one frame period and a timing chart using the invention.

DETAILED DESCRIPTION OF THE PRESENTLY PREFERRED EMBODIMENTS

The present invention will be fully described by way of embodiment modes and embodiments with reference to the accompanying drawings. However, it is to be understood that various changes and modifications will be apparent to those skilled in the art. Therefore, unless such changes and modifications depart from the scope of the present invention, they should be construed as being included therein.

Figure 1:
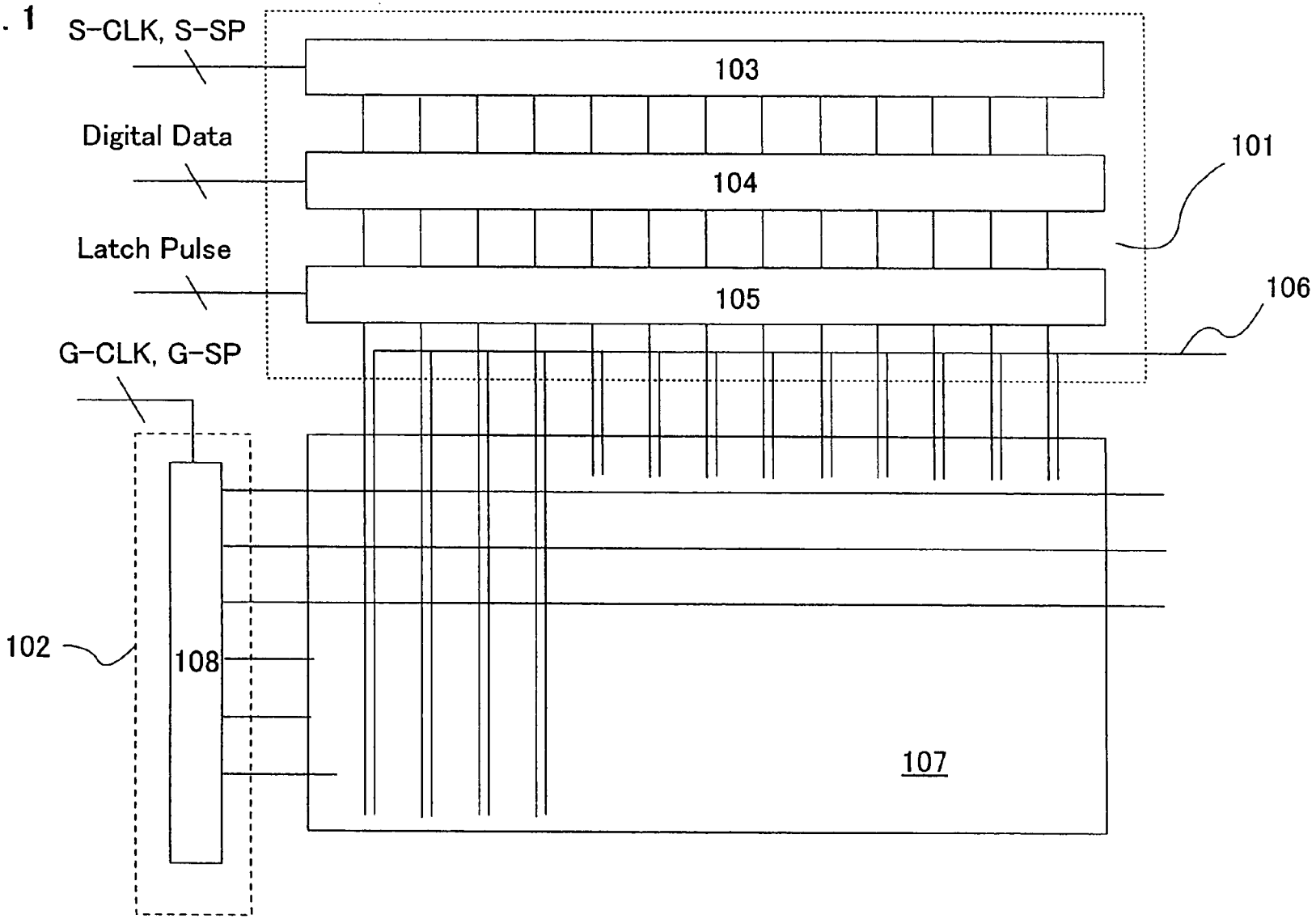
FIG. 1 is a diagram which shows a configuration of a conventional display device.
Figure 2:
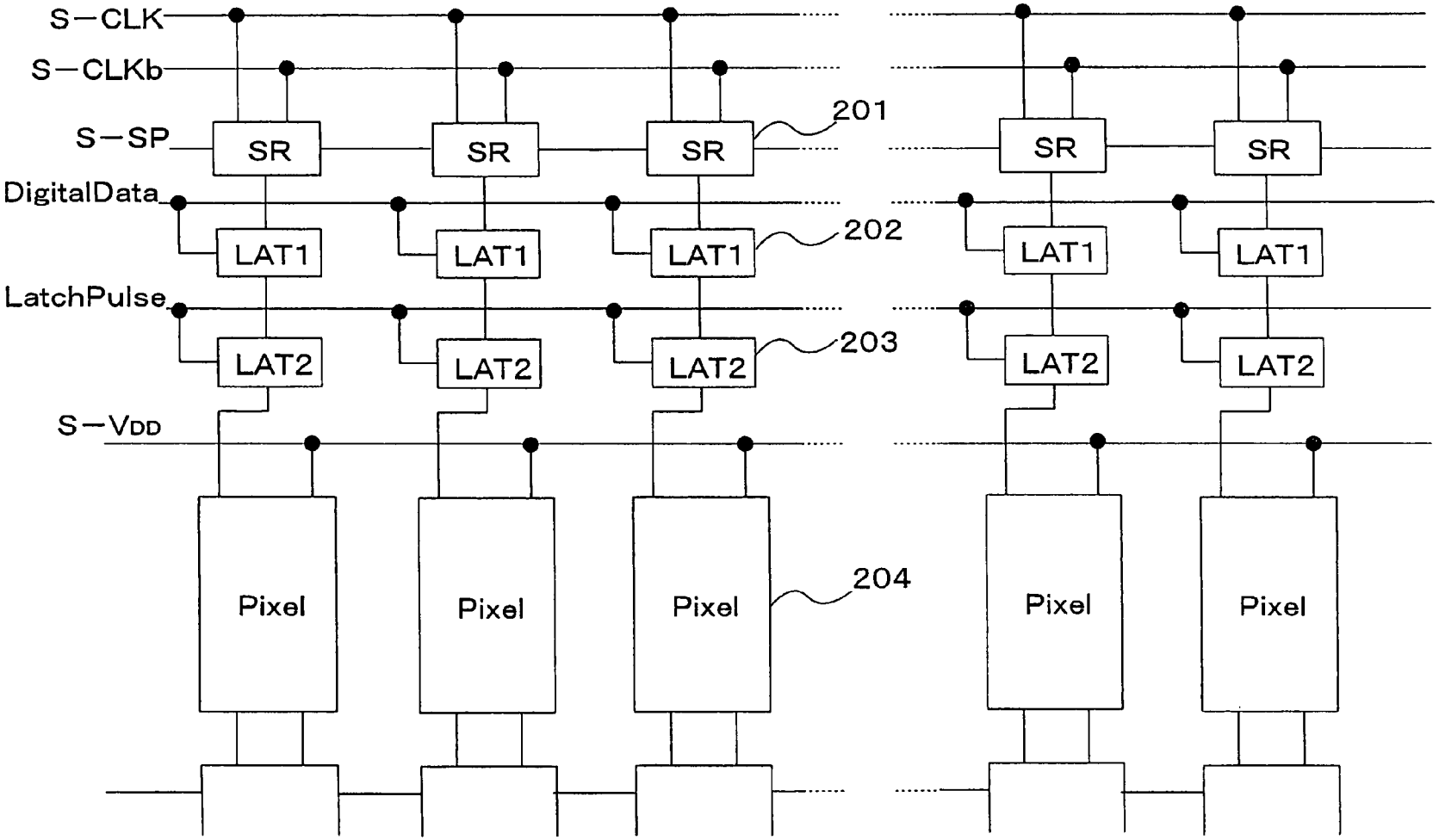
FIG. 2 is a diagram which shows a configuration of a conventional source driver circuit.
Figure 3A:
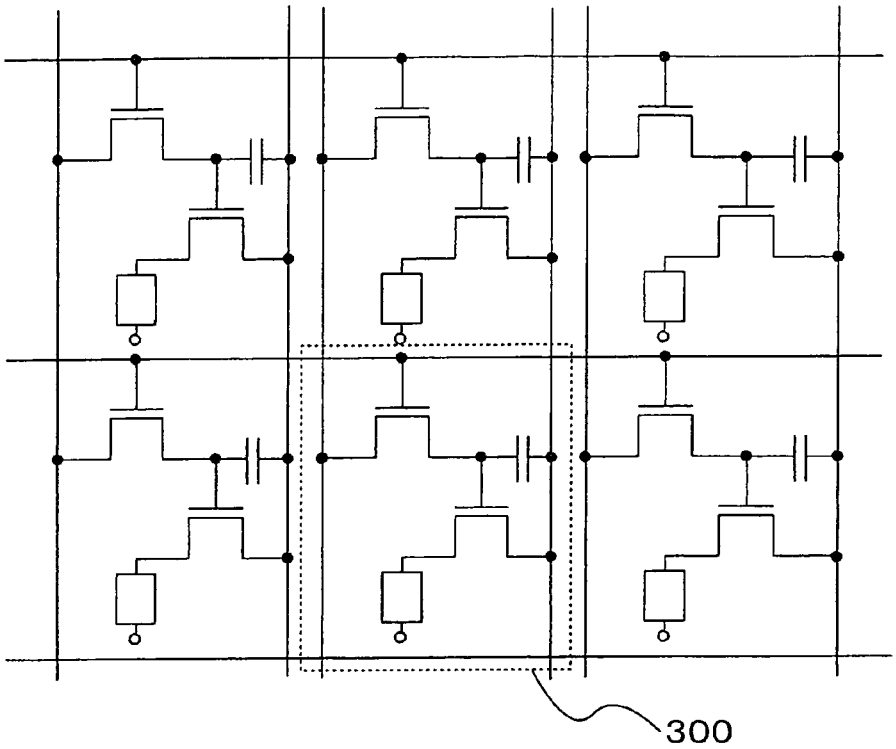
FIGS. 3(A)-3(B) are diagrams each of which shows a configuration of a conventional EL pixel.
Figure 3:
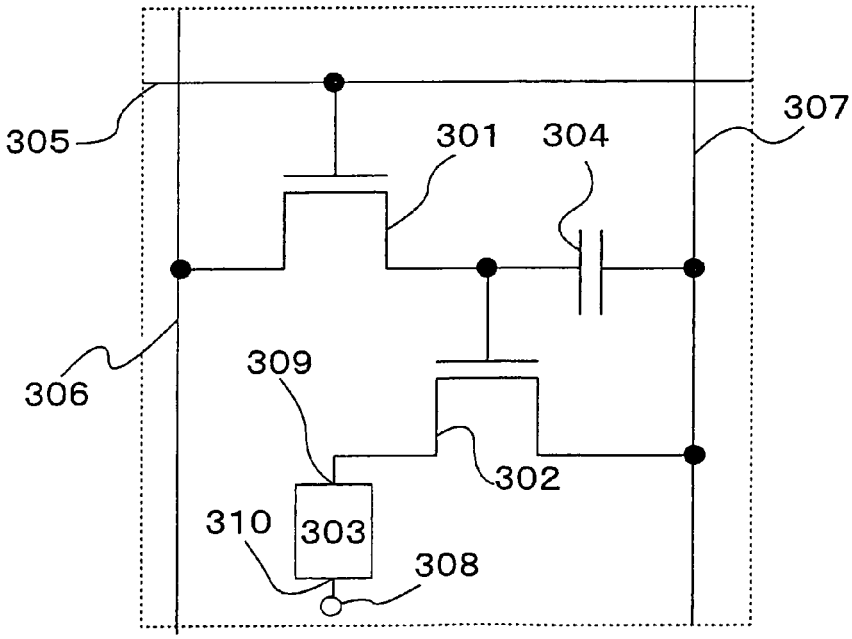
Figure 4:
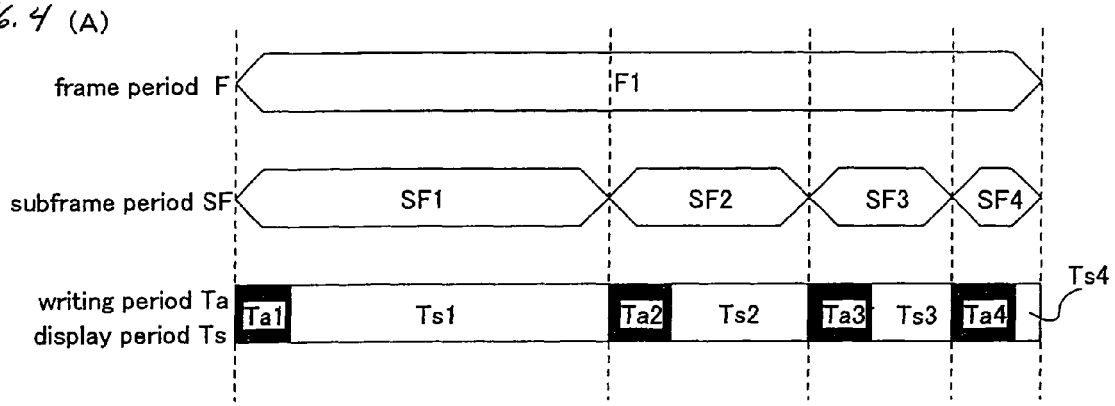
FIGS. 4(A)-4(B) are diagrams each of which shows a conventional subframe structure in one frame period and a timing chart.
Figure 4:
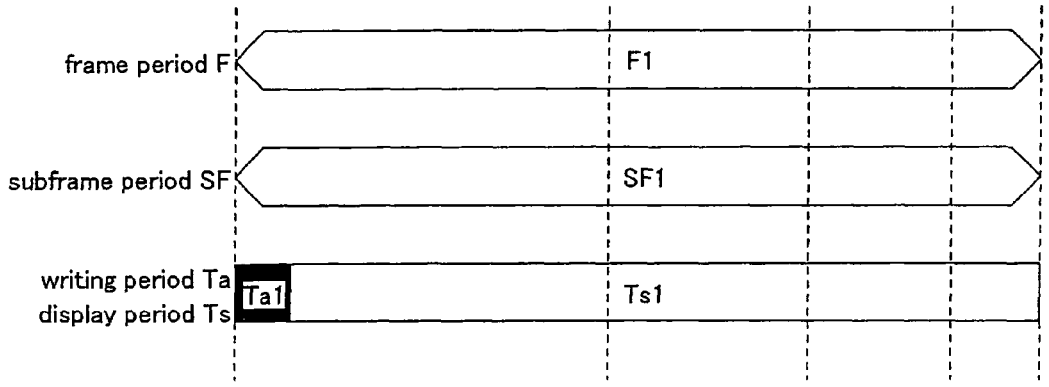
Figure 5:
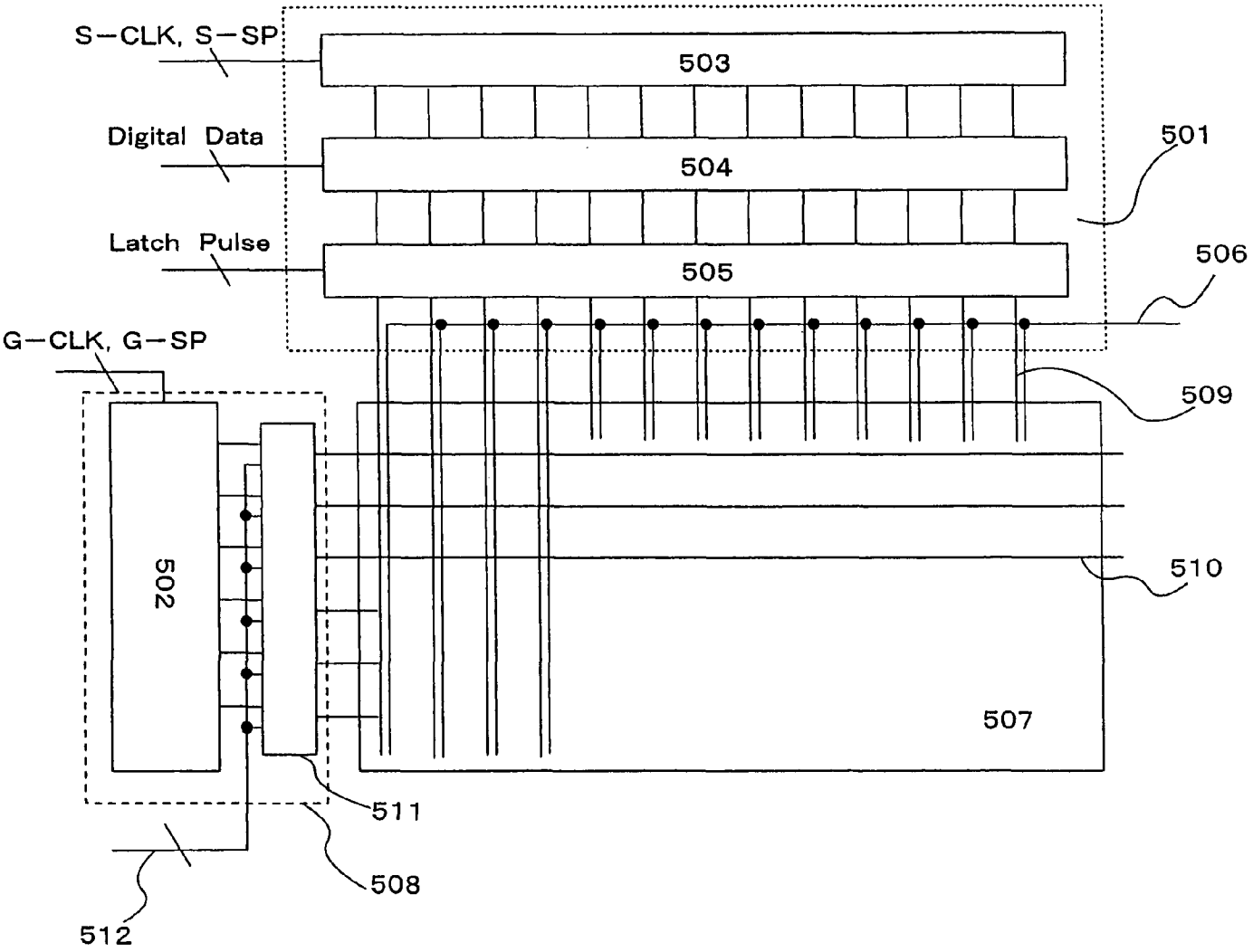
FIG. 5 is a diagram which shows one example of a configuration of a display device using the invention.

One example of a time gradation display device of the invention is described with reference to FIG. 5. A pixel portion 507 is arranged centrally. In the pixel portion, a current supply line 506 for supplying a current to an EL element is arranged as well as a source signal line 509 and a gate signal line 510. Above the pixel portion, a source driver circuit 501 for controlling the source signal line 509 is arranged. The source driver circuit 501 has a first shift register circuit 503, a first latch circuit 504, a second latch circuit 505 and the like. On the left of the pixel portion, a gate driver circuit 508 for controlling the gate signal line is arranged. The gate driver circuit 508 has a second shift register circuit 502 and a write enable circuit 511. Further, a write enable signal 512 (hereinafter referred to as GWE) is inputted to the write enable circuit 511.

Although an operation limited to only a video data writing is similar to the conventional embodiment, a function to control permission and prohibition of writing in each row is added in the invention. In a certain row, when GWE is "0", the gate signal line 510 forcibly becomes "0" and writing to pixels of a row is prohibited, while GWE is "1", a pulse is transmitted from the second shift register circuit 502 to the gate signal line 510 and writing of a row is permitted.

Figure 6:
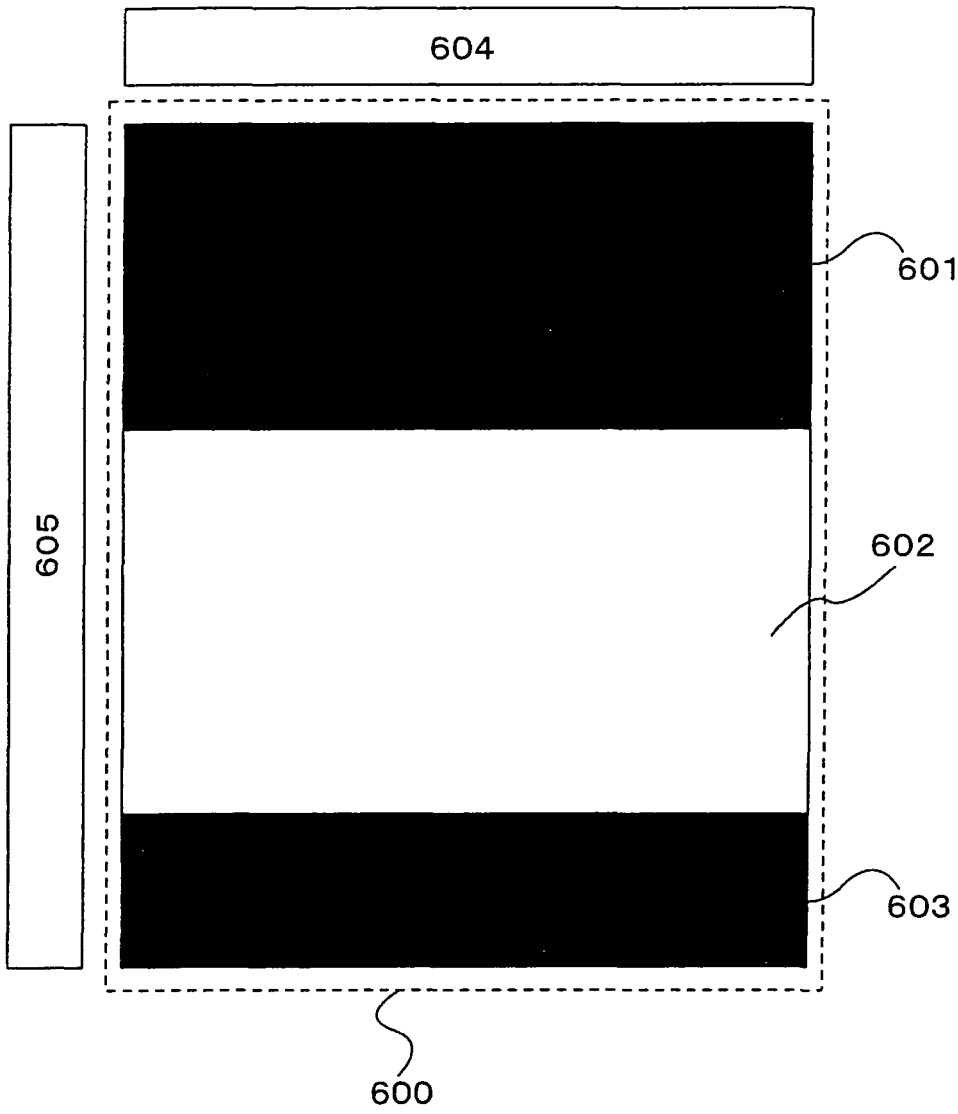
FIG. 6 is a diagram which shows a display surface of a display.

FIG. 6 is a display device including a source driver circuit 604, a gate driver circuit 605, and a display surface 600. Description is made on a case where a first display area 601 is displayed with a first subframe structure, a second display area 602 is displayed with a second subframe structure, and a third display area 603 is displayed with a third subframe structure in one frame period. Here, description is made on the case where video data is 4 bits, the first subframe structure can express $2^4$ gradations at a maximum, the second subframe structure can express 2 gradations at a maximum (video data is 1111 or 0000), and the third subframe structure can express $2^2$ gradations at a maximum (video data is YYYX, however, X and Y are "1" or "0").

Figure 7:
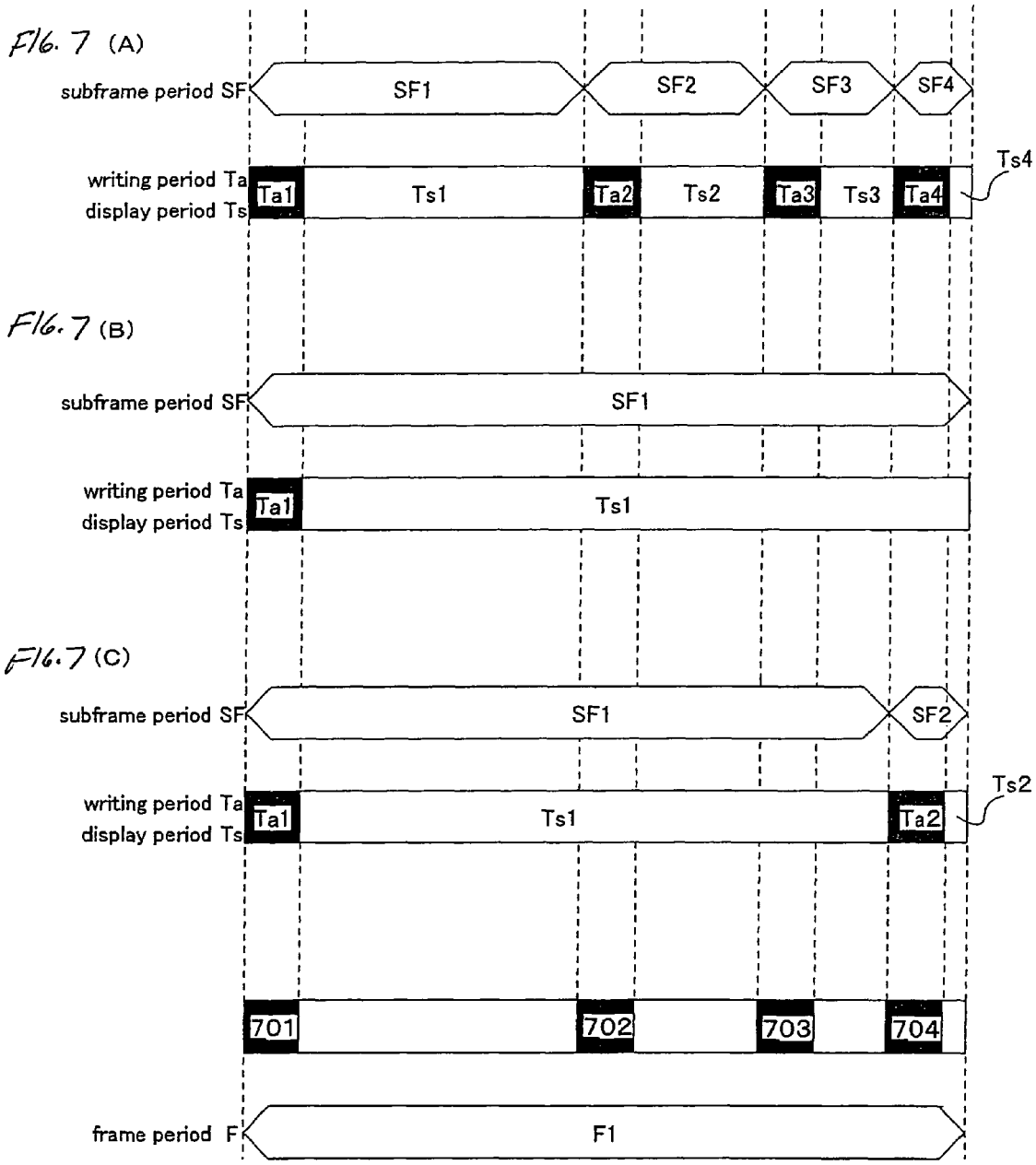
FIGS. 7(A)-7(C) are diagrams each of which shows one example of a subframe structure in one frame period and a timing chart using the invention.

A frame structure example of the invention is described with reference to FIG. 7. FIG. 7 (A) is a first subframe structure, FIG. 7 (B) is a second subframe structure, and FIG. 7 (C) is a third subframe structure. In a first writing period 701, a second writing period 702, a third writing period 703, or a fourth writing period 704, writing is performed to one region of the first display area 601, the second display area 602, and the third display area 603. Ta1 to Ta4 are writing periods of video data to pixels of all rows of a display surface, and Ts1 to Ts3 are display periods to hold video data written in each pixel after the writing period.

A writing period of video data to pixels of all rows is described with reference to FIGS. 8 (A) to 8 (C). A first display area writing period 801 is a period to write in the first display area 601 in FIG. 6, a second display area writing period 802 is a period to write in the second display area 602 in the diagram, and a third display area writing period 803 is a period to write in the third display area 603 in the diagram.

Figure 8:
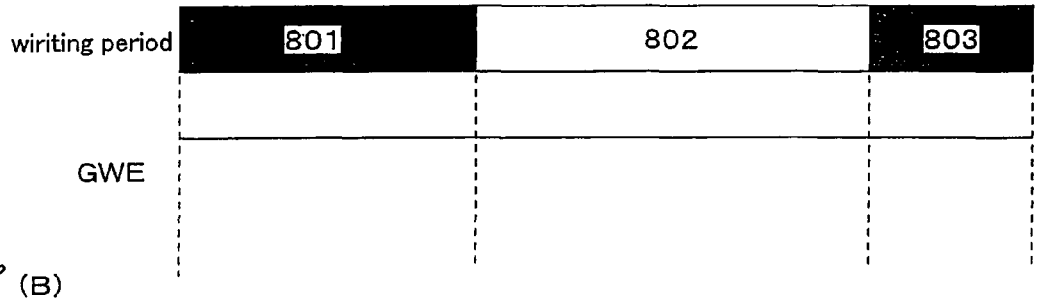
FIGS. 8(A)-8(C) are diagrams each of which shows a timing chart in which video data is written in a pixel, using the invention.
Figure 8:
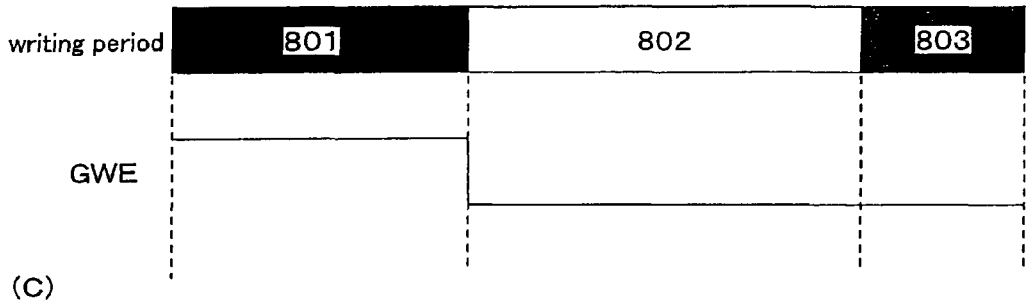
Figure 8:
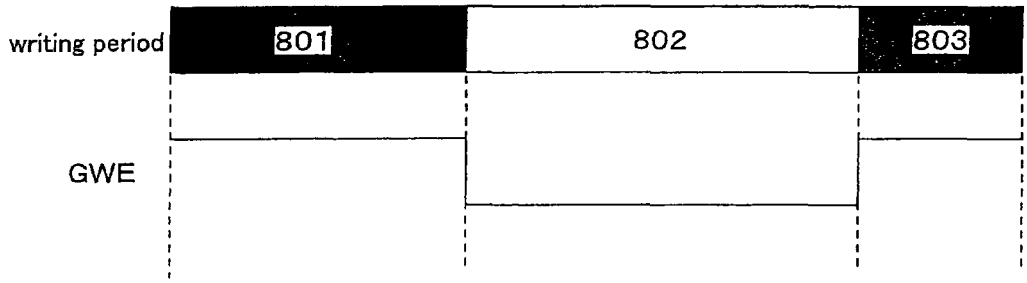

FIG. 8 (A) corresponds to the first writing period 701 in FIG. 7, GWE is always "1" when writing to a pixel, therefore, writing to an entire display surface is performed. FIG. 8 (B) corresponds to the second writing period 702 and the third writing period 703 in FIG. 7, video data is written to the first display area 601 in FIG. 6 while GWE is "1" in the first display area writing period 801, and writing is not performed to the second display area 602 in FIG. 6 and the third display area 603 in FIG. 6 while GWE is "0" in the second display area writing period 802 and the third display area writing period 803. FIG. 8 (C) corresponds to the fourth writing period 704 in FIG. 7, video data is written to the first display area 601 and the third display period 603 in FIG. 6 while GWE is "1" in the first display area writing period 801 and the third display area writing period 803, and writing is not performed to the second display area 602 in FIG. 6 while GWE is "0" in the second display area writing period 802. By the aforementioned methods, the second display area 602 and the third display area 603 in FIG. 6 can be formed by fewer subframes compared to the first display area 601.

Although description is made on the case of 4-bit video data in Best Mode for Carrying Out the Invention, the number of video bits may be other than 4 bits. Further, although the subframe structures described in Best Mode for Carrying Out the Invention were described on the case of 2 gradation expression at a maximum, the case of $2^2$ gradation expression at a maximum, and the case of $2^4$ gradation expression at a maximum, the number of gradations which can be expressed in the subframe structure is not limited. Further, although a method to display three kinds of subframe structures is described in one frame period in Best Mode for Carrying Out the Invention, the number of subframe structures to display in one frame period is not limited. Further, although logic of GWE is specified in Best Mode for Carrying Out the Invention, the logic of GWE is not specified. That is, when GWE is "1", video data may be written in the display area 601, while GWE is "0", the writing of video data does not have to be performed. Since the subframe structure can be changed in each row by the aforementioned methods, unnecessary subframes for gradation expression in a certain row can be reduced and power consumption can be reduced.

Embodiment 1

Figure 9:
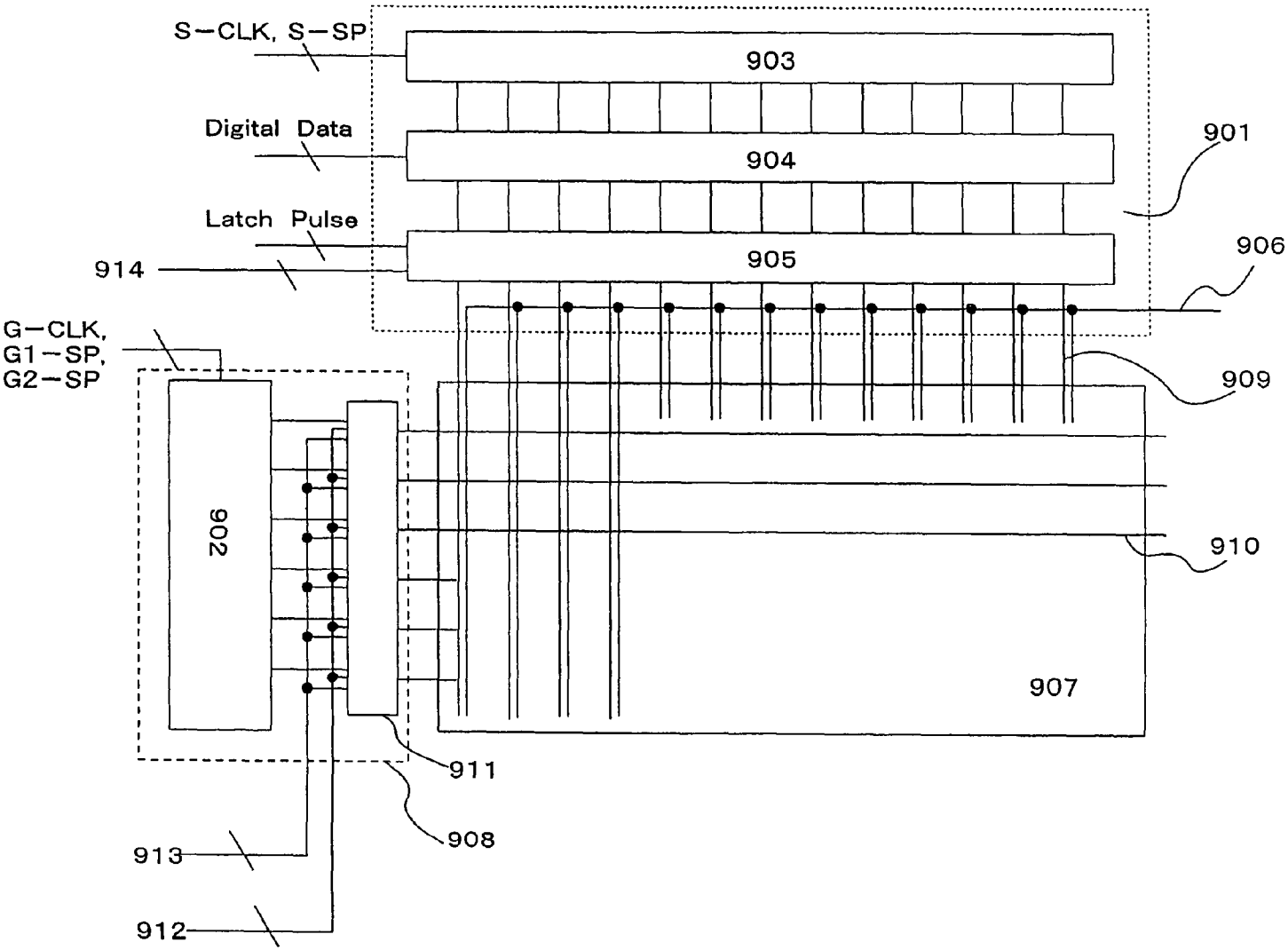
FIG. 9 is a diagram which shows one example of a configuration of a display device using the invention.

One example of a time gradation display device is shown in FIG. 9. A pixel portion 907 is arranged centrally. In the pixel portion, a current supply line 906 for supplying a current to an EL element is arranged as well as a source signal line 909 and a gate signal line 910. Above the pixel portion, a source driver circuit 901 for controlling the source signal line 909 is arranged. The source driver circuit 901 has a first shift register circuit 903, a first latch circuit 904, a second latch circuit 905 and the like. On the left of the pixel portion, a gate driver circuit 908 for controlling the gate signal line is arranged. The gate driver circuit 908 has a second shift register circuit 902 and a write enable circuit 911. In addition, a G1 write enable signal 912 (hereinafter referred to as G1WE) and a G2 write enable signal 913 (hereinafter referred to as G2WE) are inputted to the write enable circuit 911. Further, a source signal line write signal 914 (hereinafter referred to as SWE) is inputted to the second latch circuit 905.

In a display device of this embodiment, in addition to the signals inputted to the display device described in the Best Mode for Carrying Out the Invention, signals G2-SP, G2WE and SWE are added. Further, G1-SP has a similar role to G-SP described in the Best Mode for Carrying Out the Invention. An operation limited only to video data writing is similar to the method described in the conventional embodiment, and a function added in the display device of this embodiment is described.

G1-SP and G2-SP are inputted in pulse shape in synchronism with each other, and in synchronism with a clock period of G-CLK, shifted one row by one row sequentially downward from the top row of the second shift register circuit 902. Hereinafter, G1-SP is inputted to the second shift register circuit 902 and a pulse outputted from the second shift register circuit 902 is described as a G1 writing pulse, while G2-SP is inputted to the second shift register circuit 902 and a pulse outputted from the second shift register circuit 902 is described as a G2 writing pulse. In addition, a period from an output of the G1 writing pulse to a completion of outputs of all rows is described as a G1 writing period, while a period from an output of the G2 writing pulse to completion of outputs of all rows as a G2 writing period. In the write enable circuit 911, when G1WE912 is "0", writing of the G1 writing pulse to the gate signal line 910 is prohibited and an output by the G1 writing pulse is intercepted, whereas G1WE912 is "1", writing of the G1 writing pulse is permitted and the G1 writing pulse is transmitted to the gate signal line 910. Moreover, in the write enable circuit 911, when G2WE913 is "0", writing of the G2 writing pulse to the gate signal line 910 is prohibited and an output of the G2 writing pulse is intercepted. When G2WE913 is "1", writing of the G2 writing pulse is permitted and the G2 writing pulse is transmitted to the gate signal line 910. In addition, "1" is inputted to the source signal line 909 when SWE 914 is "1", whereas video data stored in the second latch circuit 905 is outputted to source signal line 909 in the case where SWE 914 is "0".

Figure 10:
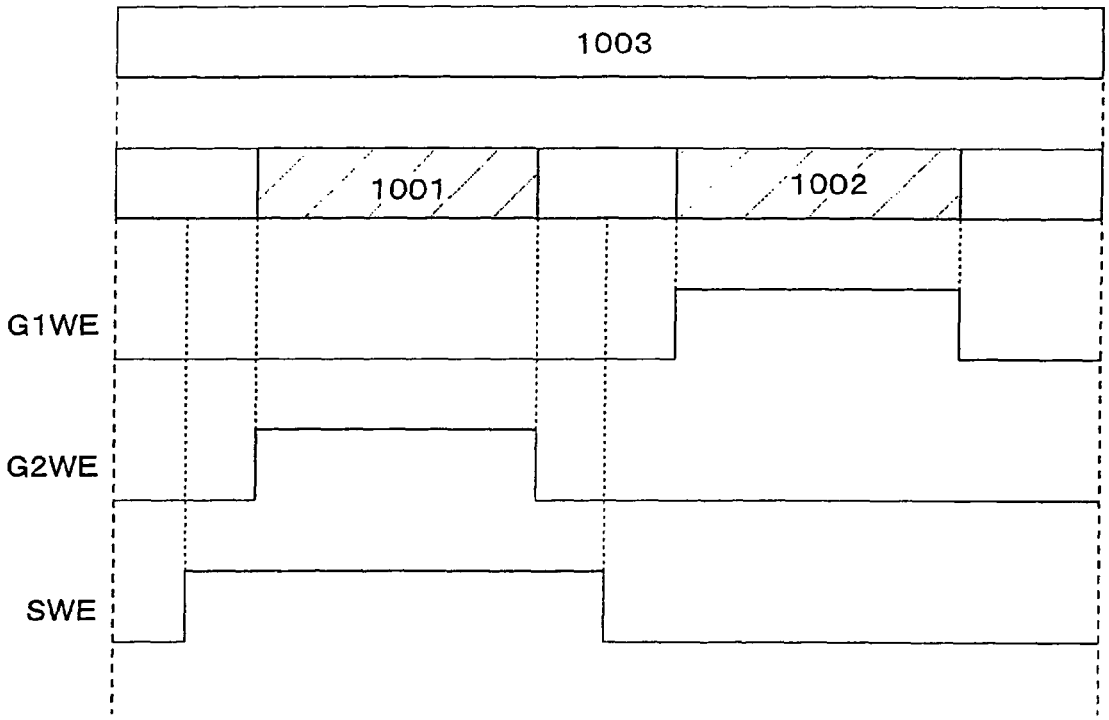
FIG. 10 is a diagram which shows a timing chart in which video data for one row is written using the invention.

Writing timing for one row is shown in FIG. 10. A row writing cycle 1003 is time needed to write one row. With G2WE "1", writing of the row to which the G2 writing pulse is inputted is performed in the first row writing period 1001, while with G1 WE "1", writing of the row to which the G1 writing pulse is inputted is performed in the second row writing period 1002. SWE is "1" in the first row writing period 1001 whereas SWE is "0" in the second row writing period 1002. Note that in the case where video data is not written in the first row writing period 1001, G2WE is "0" and in the case where video data is not written in the second row writing period 1002, G1WE is "0".

A writing timing chart of one frame period of the display device of the invention is described with reference to FIG. 11. Numerals described above the drawing of FIG. 11 are numerals by accumulating from the beginning of one frame period by using a writing cycle of one row (a row writing cycle 1003 in FIG. 10) as a unit and accumulated. In addition, Tan (n is an integral number) or Tao is a G1 writing period, and Ten (n is an integral number) is a G2 writing period. In this embodiment, since G2WE is "1" in a writing period (the first row writing period 1001 in FIG. 10) by the G2 writing pulse, a pixel written by writing operation by the G2 writing pulse emits no light. Note that Tan (n is an integral number) is a G1 writing period of n-th bit of video data, and Ten (n is an integral number) is a G2 writing period of n-th bit of video data. In addition, Tao is a G1 writing period of a plurality of low-order bits equal to each other including a least significant bit, and Teo is a G2 writing period of the plurality of low-order bits equal to each other including the least significant bit. The number of rows of a display is 320 rows in this embodiment mode. In addition, video data is described as $2^6$ gradation display at a maximum in this embodiment mode.

FIG. 11 (A) is a subframe structure example in a case of $2^6$ gradation display. FIG. 11 (B) is a subframe structure example of a case ($X_1X_1X_1X_1X_1X_1$: $X_1$ is "0" or "1") where video data for 6 bits to be written in one row are equal to each other. There is (000000) in a case where $X_1$ is 0 and there is (111111) in a case where $X_1$ is 1. FIG. 11 (C) is a subframe structure example of a case ($X_1X_oX_oX_oX_oX_o$: $X_1$ and $X_o$ are "0" or "1") where lower 5 bits among video data for 6 bits are equal to each other. FIG. 11 (D) is a subframe structure example of a case ($X_1X_2X_oX_oX_oX_o$: $X_1$, $X_2$ and $X_o$ are "0" or "1") where lower 4 bits among video data for 6 bits are equal to each other. FIG. 11 (E) is a subframe structure example of a case ($X_1X_2X_3X_oX_oX_o$: $X_1$, $X_2$, $X_3$ and $X_o$ are "0" or "1") where lower 3 bits among video data for 6 bits are equal to each other. Moreover, periods of G1 writing generation periods 1101 to 1110 are a G1 writing period in one of subframe structures, and periods of the first G2 writing generation periods 1111 to 1114 are a G2 writing period in one of each subframe structure. Display periods of each video bit are set equally among FIGS. 11 (A) to 11 (E) and the display lengths of each video bit are not changed by changing the subframe structure. Therefore, even if the subframe structure is changed, the same gradation can be provided.

Figure 12:
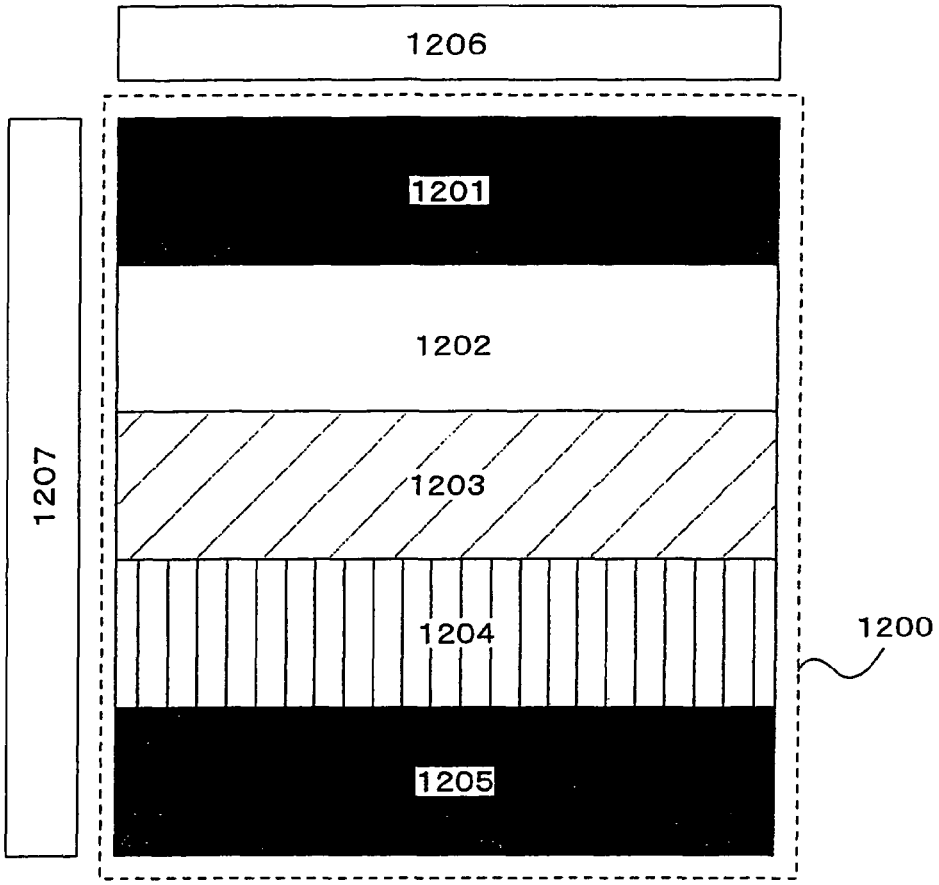
FIG. 12 is a diagram which shows a display surface of a display.

FIG. 12 shows a diagram of a display surface of a display device including a source driver circuit 1206, a gate driver circuit 1207 and a display surface 1200. Description is made on one example in which an A display area 1201 is displayed by the subframe structure shown in FIG. 11 (A), a B display area 1202 is displayed by the subframe structure shown in FIG. 11 (B), a C display area 1203 is displayed by the subframe structure shown in FIG. 11 (C), a D display area 1204 is displayed by the subframe structure shown in FIG. 11 (D), and an E display area 1205 is displayed by the subframe structure shown in FIG. 11 (E).

Figure 13A:
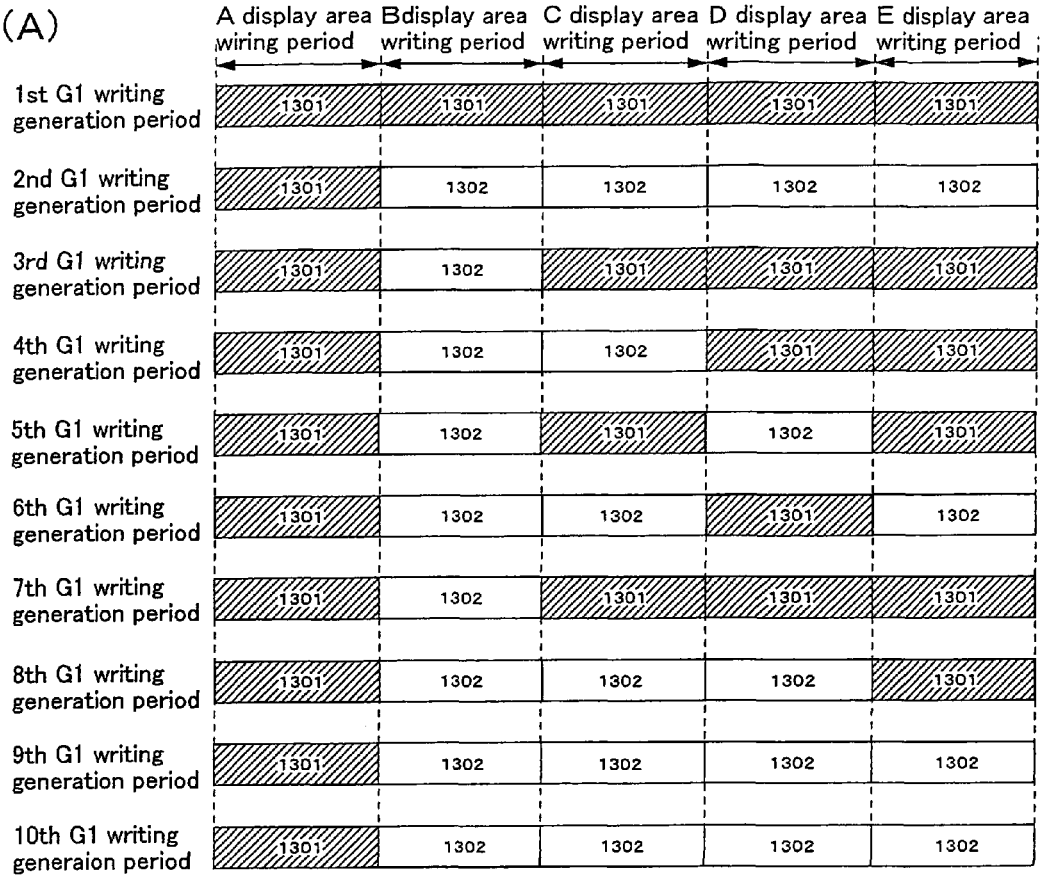
FIGS. 13(A)-13(B) are diagrams each of which shows a timing chart in which video data is written in a pixel, using the invention.
Figure 13B:
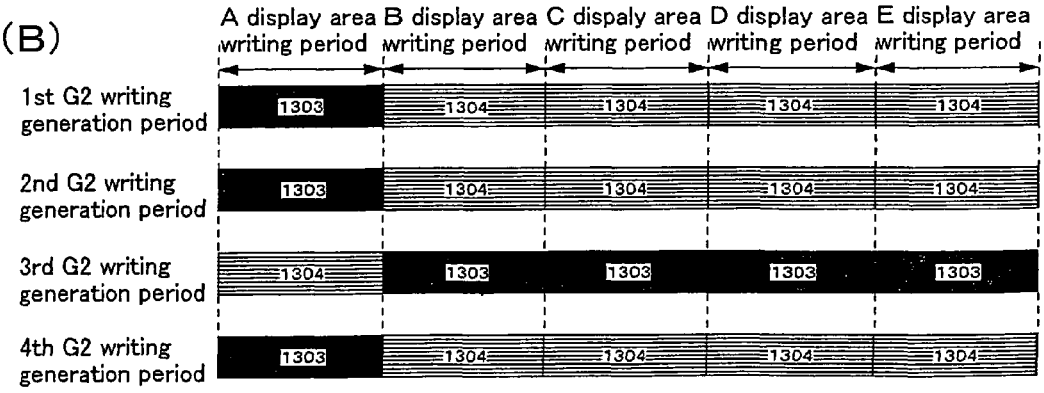

FIG. 13 (A) shows a temporally enlarged view of the G1 writing periods 1101 to 1110 in FIG. 11. FIG. 13 (B) shows a temporally enlarged view of the first G2 writing periods 1111 to 1114 in FIG. 11. A G1 write enable period 1301 is a period (hereinafter referred to as a G1 writing period) in which writing by a G1 write pulse is permitted, a G1 writing prohibited period 1302 is a period in which writing by the G1 write pulse is prohibited, a G2 write enable period 1303 is a period (hereinafter referred to as a G2 writing period) in which writing by a G2 write pulse is permitted, and a G2 writing prohibited period 1304 is a period in which writing by the G2 write pulse is prohibited. Moreover, a specific method to control permission and prohibition of writing by the G1 write pulse and permission and prohibition of writing by the G2 write pulse is as described using FIG. 10. Note that in the G1 writing period and the G2 writing period, a video data rewriting operation of the second latch circuit 905 in FIG. 9 is not required.

An A display area writing period shown in FIG. 13 is a writing period of the A display area 1201 in FIG. 12, a B display area writing period shown in FIG. 13 is a writing period of the B display area 1202 in FIG. 12, a C display area writing period shown in FIG. 13 is a writing period of the C display area 1203 in FIG. 12, a D display area writing period shown in FIG. 13 is a writing period of the D display area 1204 in FIG. 12, and an E display area writing period shown in FIG. 13 is a writing period of the E display area 1205 in FIG. 12.

In FIG. 13 (A), in the A display area writing period, a G1 writing period is generated in all of the G1 writing generation periods 1101 to 1110 shown in FIG. 11, in the B display area writing period, a G1 writing period is generated in the first G1 writing generation period 1101 in FIG. 11, in the C display area writing period, a G1 writing period is generated in the first G1 writing generation period 1101, the third G1 writing generation period 1103, the fifth G1 writing generation period 1105, and the seventh G1 writing generation period 1107 in FIG. 11, in the D display area writing period, a G1 writing period is generated in the first G1 writing generation period 1101, the third G1 writing generation period 1103, the fourth G1 writing generation period 1104, the sixth G1 writing generation period 1106, and the seventh G1 writing generation period 1107 in FIG. 11, in the E display area writing period, a G1 writing period is generated in the first G1 writing generation period 1101, the third G1 writing generation period 1103, the fourth G1 writing generation period 1104, the fifth G1 writing generation period 1105, the seventh G1 writing generation period 1107 and the eighth G1 writing generation period 1108 in FIG. 11. Moreover, in FIG. 13 (B), in the A display area writing period, a G2 writing period is generated in the first G2 writing generation period 1111, the second G2 writing generation period 1112, and the fourth G2 writing generation period 1114 shown in FIG. 11, and in the B display area writing period, the C display area writing period, the D display area writing period, and the E display area writing period, a G2 writing period is generated in the third G2 writing generation period 1113 in FIG. 11.

As described above, by the aforementioned method in which a subframe structure is changed in accordance with a condition of video data to be written in one row, in a case of low gradation, the number of subframes can be reduced, therefore, data transfer amount to a panel, the number of writing to a pixel, and operating quantity of a display driver circuit can be greatly reduced to contribute to low power consumption.

In a display device using the invention, description is made on an effect of power consumption reduction with reference to FIG. 27.

FIGS. 27 (*a*) to 27 (*g*) show seven kinds of display patterns. Ratio of power consumption in a case of displaying each pattern by using the invention to power consumption in the case of displaying with 10 subframes with $2^6$ gradation in which a method of Patent Document 1 is applied, is shown in percentage. That is, a power consumption in the case of displaying by using the invention is divided by a power consumption in the case of displaying by a conventional method, and then multiplied by 100. However, power consumption flowing to a light-emitting element such as an EL is not considered. As a result, reduction of power consumption is recognized in which all white pattern of FIG. 27 (*a*) is 59.44%, all black pattern of FIG. 27 (*b*) is 51.95%, a striped pattern (each row) of FIG. 27 (*c*) is 40.95%, gradation (each row) of FIG. 27 (*d*) is 73.35%, text mode of FIG. 27 (*e*) is 65.93%, the first image of FIG. 27 (*f*) is 89.47%, and the second image of FIG. 27 (*g*) is 92.45%.

In the patterns of FIGS. 27 (*a*) to 27 (*g*), an effect of power consumption reduction of about 10% to 50% appears compared with the technique displayed with 10 subframes in which the method of Patent Document 1 is applied. Particularly, in the display pattern, an effect is large for a pattern with a little gradation contrast or a pattern in which gradation is changed in parallel to a gate driver.

Figure 14:
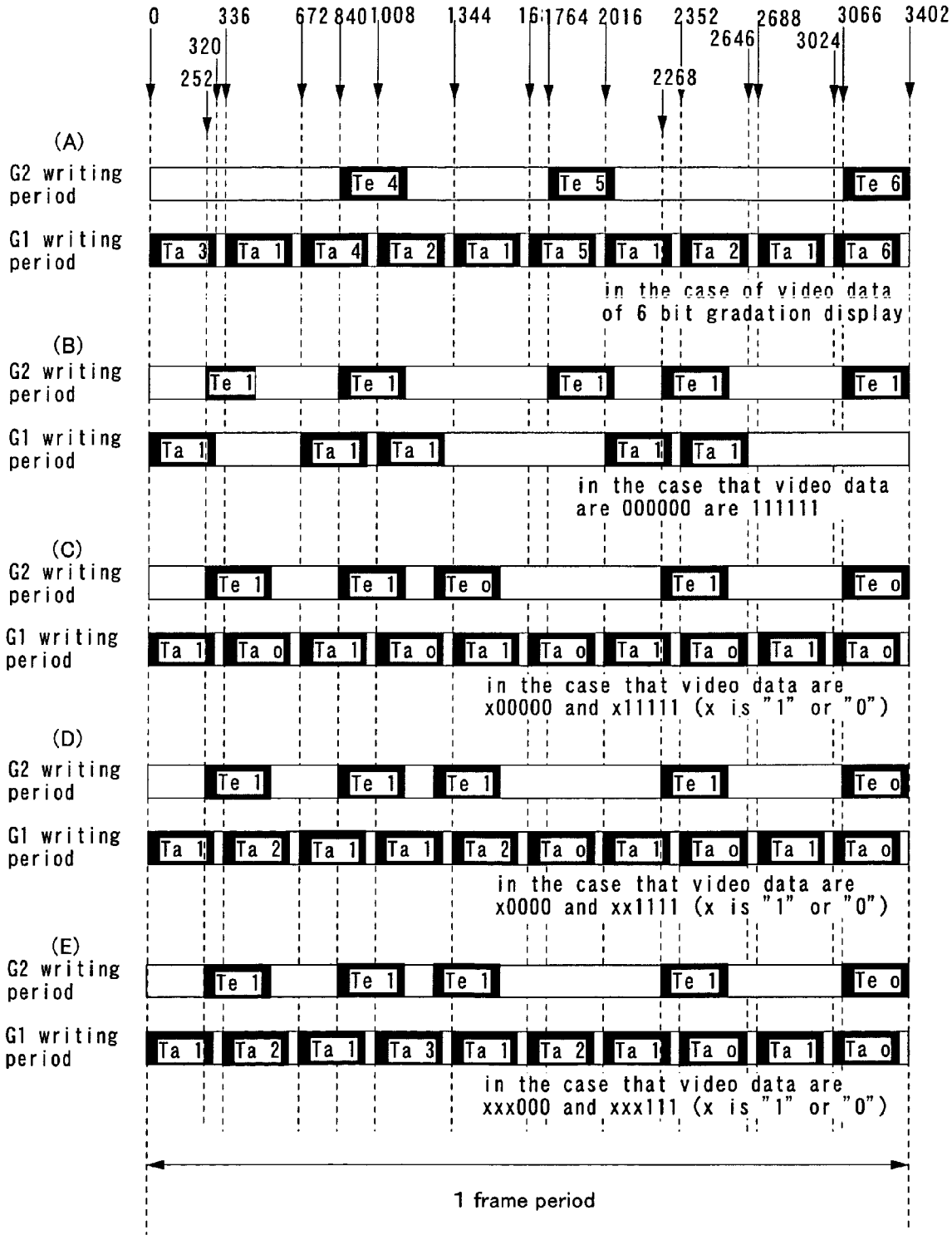
FIGS. 14(A)-14(E) are diagrams each of which shows one example of a subframe structure in one frame period and a timing chart using the invention.

FIG. 14 is a subframe structure example which is different from the one shown in FIG. 11. FIG. 14 (A) is a subframe structure which can express $2^6$ gradation at a maximum, and is the same subframe structure as that in FIG. 11 (A). In FIG. 11 (A), although the number of G1 writing periods, namely Ta1, of the first bit in one frame is 4, the number of Ta1 is 5 and are dispersed in one frame in FIGS. 14 (B) to 14 (E). Thus, in accordance with a condition of video data inputted to one row, the number of subframes which display a certain video bit and are more than those of gradations which can be displayed is provided; furthermore, a plurality of subframes corresponding to a certain bit is provided in one frame period; thereby a pseudo contour can be reduced.

In the case of using two subframe structures which have the same number of gradations at a maximum which can be expressed between certain two rows, two subframe structures may be different from each other in the numbers of subframes or display orders of video bits.

Although the case of six bits of video data is described in this embodiment mode, the number of video bits may be any number. Moreover, the subframe structure of the invention is not limited to the one shown in this embodiment. Further, in the invention, a condition of video data for one row used in a subframe structure is not limited to the one described in this embodiment. Moreover, each signal in which logic is specified in this embodiment may be operated using inverted logic to the aforementioned logic. Further, a subframe structure may also be changed in each row or may also be changed in each plurality of rows.

Embodiment 2

Figure 15:
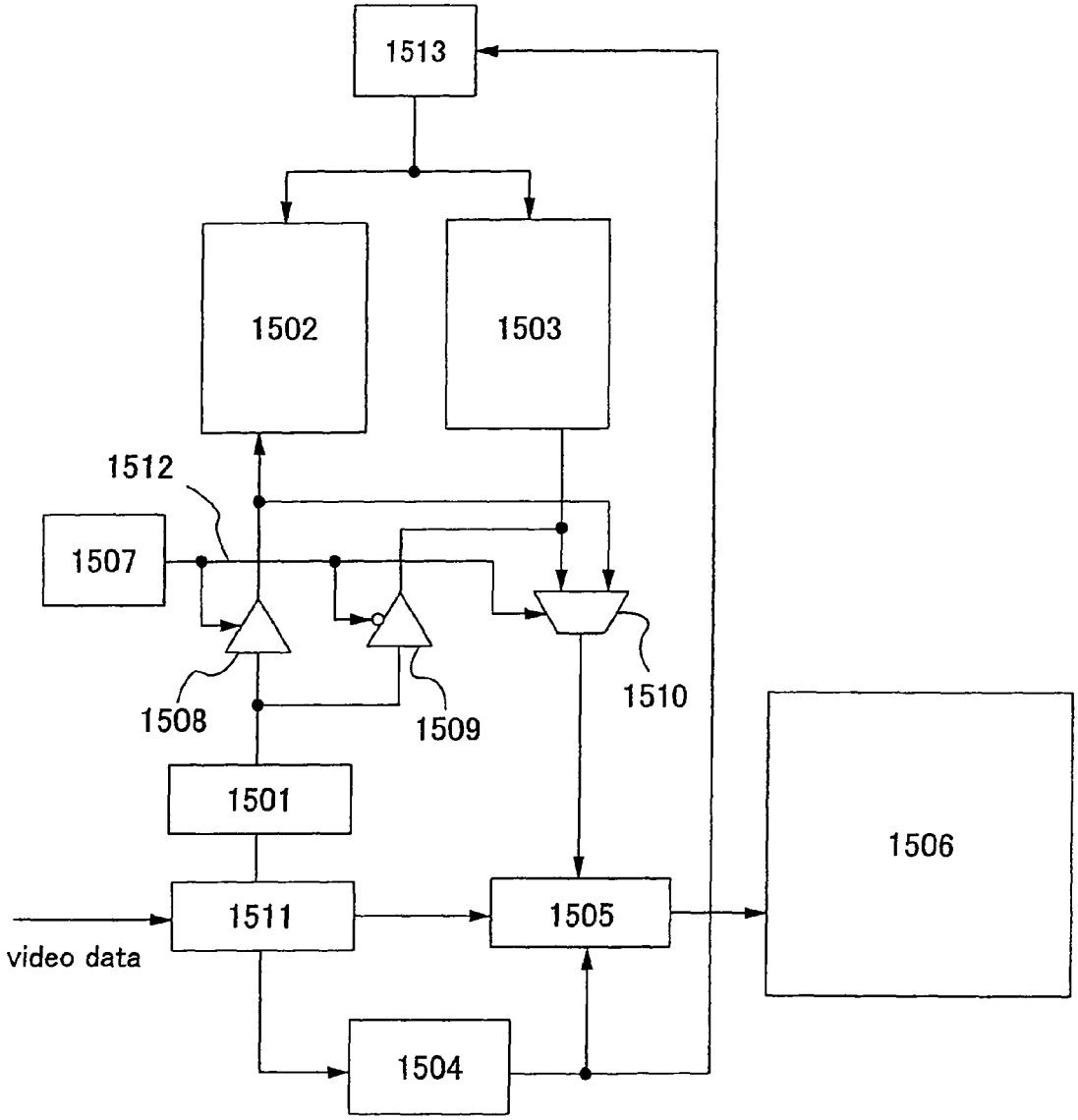
FIG. 15 is a diagram which shows a configuration of a display controller using the invention.

A configuration of a display controller is shown in FIG. 15. A display controller of this embodiment includes a format conversion circuit 1501, a first memory circuit 1502, a second memory circuit 1503, a third memory circuit 1504, a display control circuit 1505, a display 1506, a memory circuit switching circuit 1507, a first write enable circuit 1508, a second write enable circuit 1509, a selector 1510, a display mode discriminating circuit 1511, and a memory control circuit 1513. The display mode discriminating circuit 1511, the display control circuit 1505, the third memory circuit 1504, the format conversion circuit 1501 and the memory control circuit 1513 are electrically connected, the format conversion circuit 1501 is electrically connected to the first write enable circuit 1508 and the second write enable circuit 1509, the first write enable circuit 1508 is electrically connected to the first memory circuit 1502, the second write enable circuit 1509 is electrically connected to the second memory circuit 1503, the memory control circuit 1513 is electrically connected to the first memory circuit 1502 and the second memory circuit 1503, the first memory circuit 1502 and the second memory circuit 1503 are electrically connected to the selector 1510, the selector 1510 is electrically connected to the display control circuit 1505, an output of the display control circuit 1505 is inputted to the display 1506, and the memory circuit switching circuit 1507 is electrically connected to the first write enable circuit 1508, the second write enable circuit 1509 and the selector 1510.

Although one frame period is displayed with a plurality of subframe structures in this embodiment, an arbitrary one among the plurality of subframe structures is hereinafter referred to as a display mode. First, video data is inputted to the display mode discriminating circuit 1511 to hold video data for one row. Furthermore, in the display mode discriminating circuit 1511, a display mode for performing display based on the video data for one row which is held is discriminated and data of a discrimination result is held in the third memory circuit 1504. Here, the data of the discrimination result is digital data corresponding to each display mode one-to-one composed with one bit or more. This discrimination operation is performed in video data of all rows, and the third memory circuit holds data of all discrimination results corresponding to all rows respectively. Video data is inputted from the display mode discriminating circuit 1511 to the format conversion circuit 1501, and is converted to an appropriate format for performing display of a time gradation method. A specific method of a format conversion is described later.

Next, video data which is format converted is inputted to the first write enable circuit 1508 and the second write enable circuit 1509. A memory circuit switching signal 1512 which is an output from the memory circuit switching circuit 1507 is inputted to the first write enable circuit 1508 and the second write enable circuit 1509. When the memory circuit switching signal 1512 is "1", video data inputted to the first write enable circuit 1508 is outputted from the first write enable circuit 1508, while the memory circuit switching signal 1512 is "0", video data inputted to the second write enable circuit 1509 is outputted from the second write enable circuit 1509. By the control of the memory control circuit 1513, the video data outputted from the first write enable circuit 1508 is written in the first memory circuit 1502, and the video data outputted from the second write enable circuit 1509 is written in the second memory circuit 1503.

Next, when the memory circuit switching signal 1512 is "1", under the control of the memory control circuit 1513, the video data stored in the second memory circuit 1503 is read, and through the selector 1510, inputted to the display control circuit 1505. In addition, when the memory circuit switching signal 1512 is "0", under the control of the memory control circuit 1513, the video data stored in the first memory circuit 1502 is read, and through the selector 1510, inputted to the display control circuit 1505. Here, when video data of a certain row is read from the first memory circuit 1502 and the second memory circuit 1503, referring to data of the display mode discrimination result stored in the third memory circuit 1504 corresponding to the certain row, appropriate video data is read.

For example, in order to write video data of h-th bit (h is an integral number) in a pixel of m-th row (m is an integral number) of a display, after video data of m-th row and h-th bit is read from the first memory circuit 1502 or the second memory circuit 1503, when video data is written in a pixel of (m+1)-th row, referring to the data of the display mode discrimination result stored in the third memory circuit 1504, in the case of a discrimination result in which k-th bit (k is an integral number) is written, video data of (m+1)-th row and k-th bit is read from the first memory circuit 1502 or the second memory circuit 1503. At this time, k and h do not need to be equal. Moreover, when data of the display mode discrimination result stored in the third memory circuit 1504 shows that rewriting of video data held in the pixel of (m+1)-th row is not required, a read operation from the first memory circuit 1502 or the second memory circuit 1503 does not required to be performed.

In the display control circuit 1505, a display control signal such as S-SP, S-CLK, G1-SP, G-2SP, G-CLK, G1WE, G2WE, or SWE is produced referring to the third memory circuit 1504. For example, when video data is written in the pixel of m-th row, data of a display mode discrimination result corresponding to the m-th row is read from the third memory circuit 1504, in the case where data of the display mode discrimination result shows rewriting of video data of the pixel of m-th row, the display control signal which is required for writing is generated, while in the case where the holding of video data of the pixel of m-th row is shown, only the display control signal which is minimally required is generated for holding video data of the pixel of m-th row. In addition, in synchronism with the produced display control signal, the video data inputted to the display control circuit 1505 is transmitted to the display 1506 along with the display control signal at a favorable timing.

Next, an operation of the format conversion circuit 1501 is described. When data of m-th row is transmitted, typically, data corresponding to all video bits of m-th row is transmitted to the format conversion circuit 1501 in parallel. However, in a time gradation display method, in the case of rewriting video data of the pixel of m-th row, h-th bit among video bits is required to be read from the first memory circuit 1502 or the second memory circuit 1503 in succession. Accordingly, data of the same video bit of a plurality of pixels may be preferably stored in one address of a memory circuit, which is efficient in reading. Therefore, before writing in the memory circuit, video data transmitted in parallel is grouped in each bit, and video data of the same video bit is written in one address of the memory circuit. The aforementioned operation is performed in the format conversion circuit 1501.

Figure 16:
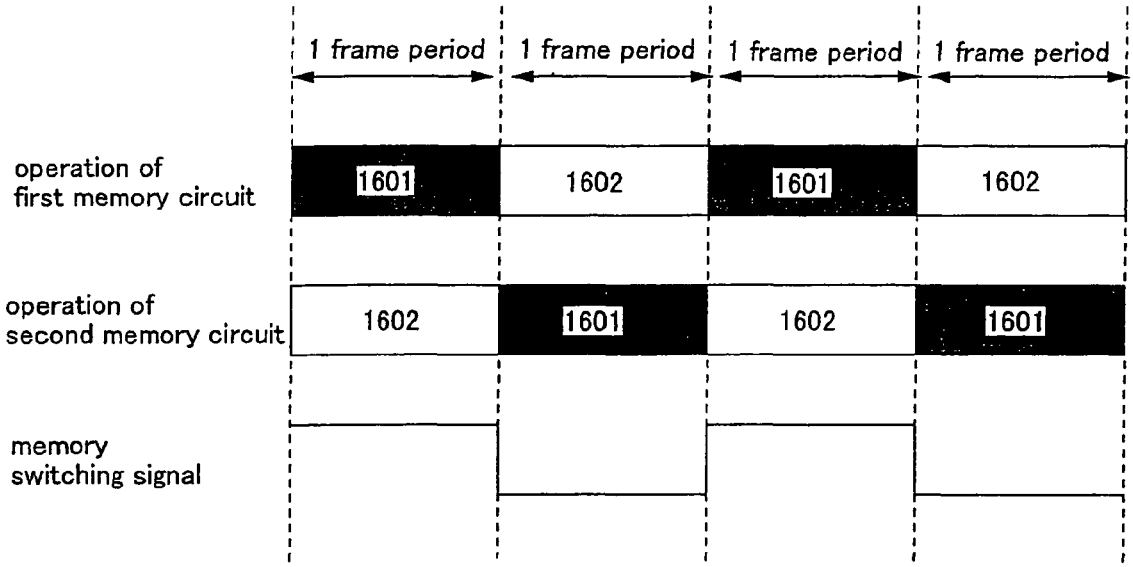
FIG. 16 is a diagram which shows an operation of a display controller using the invention.

Next, an operation of a memory circuit switching signal is described with reference to FIG. 16. As shown in FIG. 16, the memory circuit switching signal 1512 inverts its logic in synchronism with the end of a frame period. In i-th frame (i is an integral number), when a memory circuit switching signal is "1", writing of video data is performed to the first memory circuit 1502 and a read of video data is performed from the second memory circuit 1503. Subsequently, in (i+1)-th frame, the memory circuit switching signal 1512 is inverted to be "0", the read of video data is performed from the first memory circuit 1502 so that the writing of video data is performed to the second memory circuit 1503.

Although one set of a plurality of display modes which composes one frame is used in this embodiment mode, using a plurality of sets, one set among the plurality of sets may be able to be selected by an external switch or an external signal. For example, two sets of the plurality of display modes which composes one frame are prepared, among two sets, low power consumption is emphasized and one display mode is composed of subframes as few as possible in one set, while a pseudo contour measure is emphasized and a subframe structure is such that a subframe of a certain bit is dispersed as much as possible in one frame period in the other set, and both are used arbitrarily with an external signal or the like.

Embodiment 3

Figure 17:
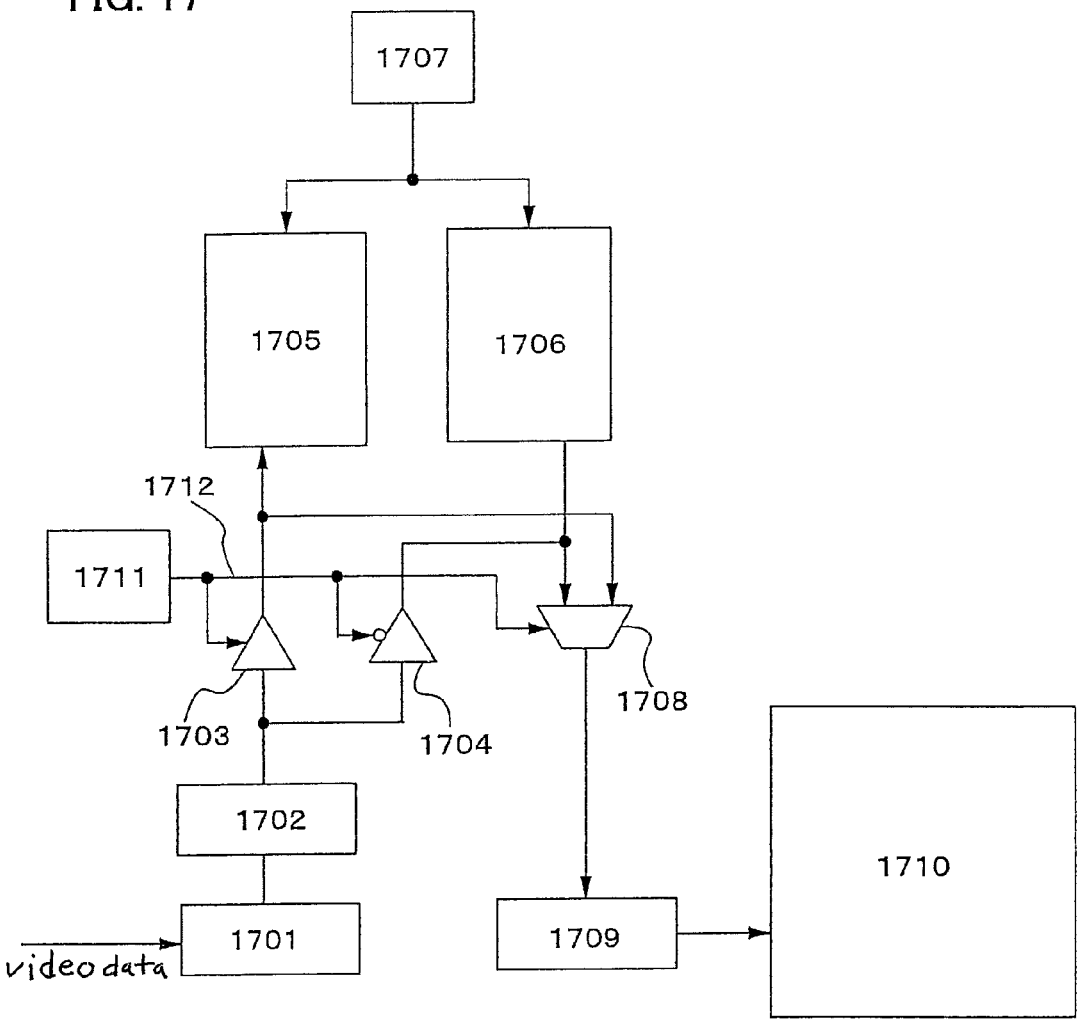
FIG. 17 is a diagram which shows a configuration of a display controller using the invention.

A display controller using the invention is described with reference to FIG. 17. A display controller of this embodiment has a display mode discriminating circuit 1701, a format conversion circuit 1702, a first write enable circuit 1703, a second write enable circuit 1704, a first memory circuit 1705, a second memory circuit 1706, a memory control circuit 1707, a selector 1708, a display control circuit 1709, a display 1710, and a memory circuit switching circuit 1711. The display mode discriminating circuit 1701 and the format conversion circuit 1702 are electrically connected, the format conversion circuit 1702 is electrically connected to the first write enable circuit 1703 and the second write enable circuit 1704, the first write enable circuit 1703 is electrically connected to the first memory circuit 1705, the second write enable circuit 1704 is electrically connected to the second memory circuit 1706, the memory control circuit 1707 is electrically connected to the first memory circuit 1705 and the second memory circuit 1706, the first memory circuit 1705 and the second memory circuit 1706 are electrically connected to the selector 1708, the selector 1708 is electrically connected to the display control circuit 1709, an output of the display control circuit 1709 is inputted to the display 1710, and the memory circuit switching circuit 1711 is electrically connected to the first write enable circuit 1703, the second write enable circuit 1704 and the selector 1708.

Although one frame period is displayed with a plurality of subframe structures in the invention, an arbitrary one among the plurality of subframe structures is hereinafter referred to as a display mode. First, video data is inputted to the display mode discriminating circuit 1701 to hold video data for one row. Furthermore, in the display mode discriminating circuit 1701, a display mode for performing display based on the video data for one row which has been held is distinguished, and data of a discrimination result and video data are transmitted to the format conversion circuit 1702. A specific method of a format conversion is described later.

Next, video data is converted to an appropriate format for performing display by a time gradation display method based on data of the discrimination result. A specific method of a format conversion is described later. Next, video data which has been format converted and data of the display mode discrimination result are inputted to the first write enable circuit 1703 and the second write enable circuit 1704. A memory circuit switching signal 1712 which is an output from the memory circuit switching circuit 1711 is inputted to the first write enable circuit 1703 and the second write enable circuit 1704. When the memory circuit switching signal 1712 is "1", video data and the data of the display mode discrimination result inputted to the first write enable circuit 1703 are outputted from the first write enable circuit 1703, whereas the memory circuit switching signal 1712 is "0", video data and data of the display mode discrimination result inputted to the second write enable circuit 1704 are outputted from the second write enable circuit 1704. By the control of the memory control circuit 1707, the video data and the data of the display mode discrimination result outputted from the first write enable circuit 1703 are written in the first memory circuit 1705, and the video data and the display mode discrimination result outputted from the second write enable circuit 1704 are written in the second memory circuit 1706.

Next, when the memory circuit switching signal 1712 is "1", under the control of the memory control circuit 1707, the video data and the data of the display mode discrimination result stored in the second memory circuit 1706 are read, and through the selector 1708, inputted to the display control circuit 1709. Moreover, when the memory circuit switching signal 1712 is "0", under the control of memory control circuit 1707, the video data and the data of the display mode discrimination result stored in the first memory circuit 1705 are read, and through the selector 1708, inputted to the display control circuit 1709. In the display control circuit 1709, display control signals such as S-SP, S-CLK, G1-SP, G2-SP, G-CLK, G1WE, G2WE, and SWE are produced referring to the data of the display mode discrimination result read from the first memory circuit 1705 or the second memory circuit 1706.

For example, when video data is written in the pixel of m-th row, in the case where data of the display mode discrimination result shows rewriting of video data of the pixel of m-th row, the display control signal which is required for writing is generated, while in the case where the holding of video data of the pixel of m-th row is shown, only the display control signal which is minimally required is generated for holding video data of the pixel of m-th row. Moreover, in synchronism with the produced display control signal, the video data inputted to the display control circuit 1709 is transmitted to the display 1710 along with the display control signal at a favorable timing.

Next, an operation of the format conversion circuit 1702 is described. When data of m-th row is transmitted, typically, data of the same video bit is transmitted in parallel. However, in a time gradation display method, in the case of rewriting video data of the pixel of m-th row, h-th bit among video bits is required to be read from the first memory circuit 1705 or the second memory circuit 1706 in succession. Although Embodiment 2 describes that video data of the same bit is stored in the same address of the memory circuit, video data which belongs to the same writing generation period is stored in the same address of the memory circuit in this embodiment mode. Moreover, in a certain video data writing generation period, the data which distinguishes whether video data is updated or held in a certain row is written at the same time.

Switching operations of writing and reading of the first memory circuit 1705 and the second memory circuit 1706 are similar to Embodiment 2.

Although one set of a plurality of display modes which composes one frame is used in this embodiment mode, using a plurality of sets, one set among the plurality of sets may be able to be selected by an external switch or an external signal. For example, two sets of the plurality of display modes which composes one frame are prepared, among two sets, low power consumption is emphasized and one display mode is composed of subframes as few as possible in one set, while a pseudo contour measure is emphasized and a subframe structure such that subframes of a certain bit is dispersed as much as possible in one frame period in the other set, and both are used arbitrarily with an external signal or the like.

Embodiment 4

Figure 18:
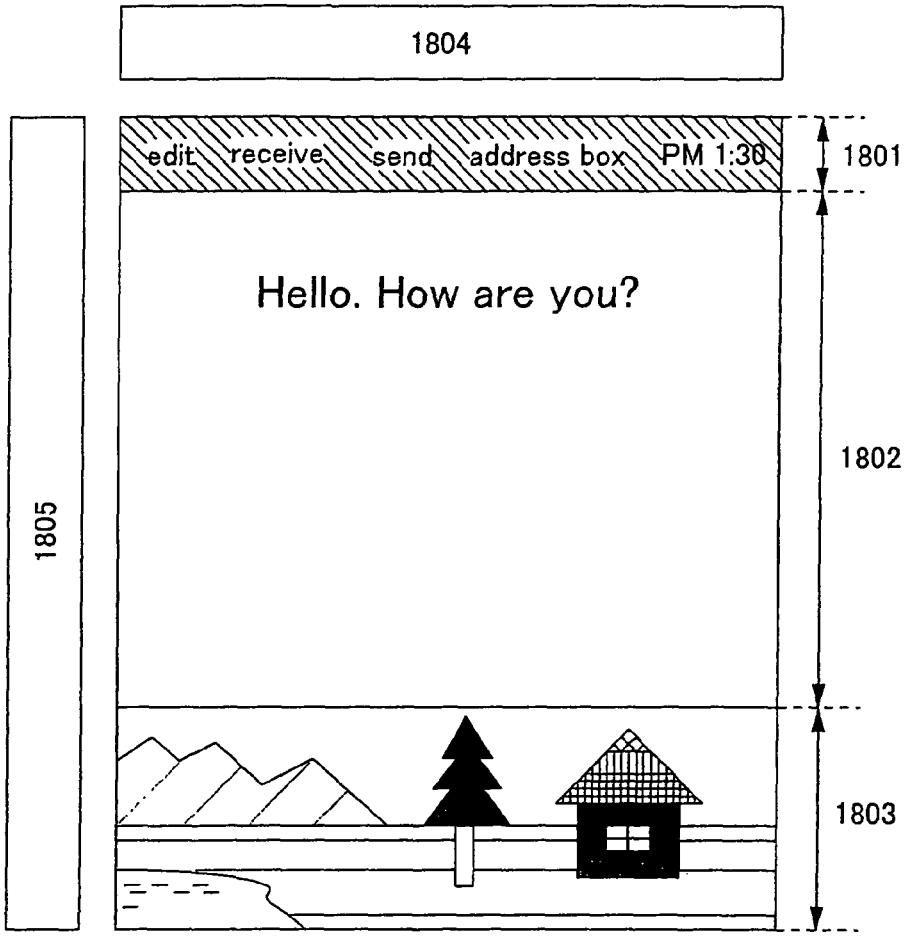
FIG. 18 is a diagram which shows a display surface of a display.

FIG. 18 is a display example of a display such as a cellular phone. In the periphery of a display surface, a source driver circuit 1804 and a gate driver circuit 1805 are provided. A menu bar is displayed in a first display area 1801, a text is displayed in a second display area 1802, and an image is displayed in a third display area 1803. $2^3$ color gradation display is performed in the first display area 1801, 2 monochromatic gradation display is the second display area 1802, and $2^6$ full color gradation display is the third display area 1803. The second display area 1802 can be formed of one subframe in one frame period, the third display area 1803 can be formed of N subframes (N is an integral number of 6 or more) in one frame period, and the first display area 1801 can be formed of M subframes (M is an integral number of 3 or more to less than 6) in one frame period. However, in the third display area 1803, when there is a display row which is less than $2^6$ gradation at a maximum, the number of subframes in the row may be less than N, and in the first display area 1801, when there is a display row which is less than $2^3$ gradation at a maximum, the number of subframes in the row may be less than M. In this manner, even in a case where a text display and an image coexist in one frame, an appropriate subframe structure is selected every row and power consumption can be suppressed.

Embodiment 5

One configuration example of the display device described in Embodiments 1 to 4 is described with reference to drawings.

Figure 19:
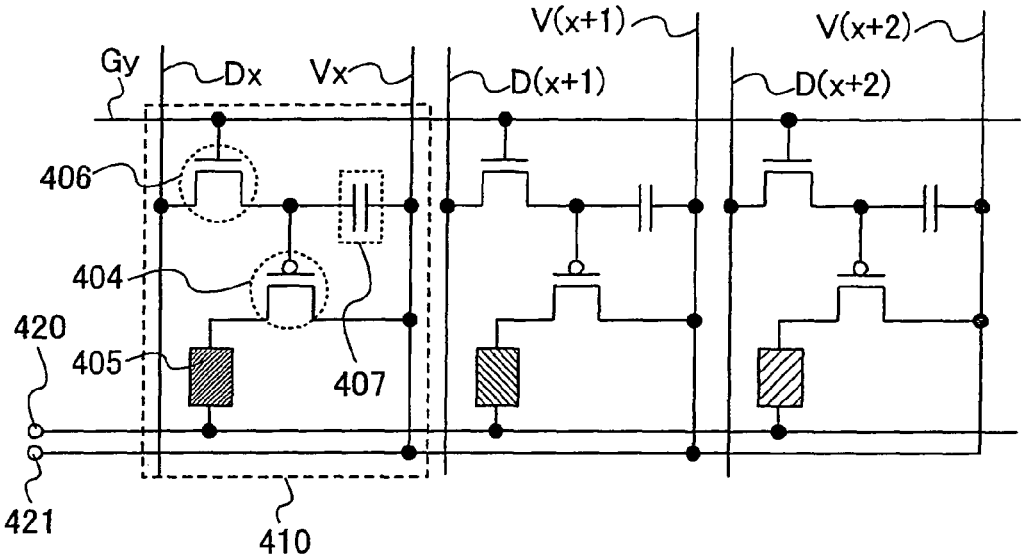
FIG. 19 is a diagram which shows one example of a circuit of a pixel applicable to a display of the invention.

A pixel 410 shown in FIG. 19 shows a configuration of a pixel provided with two transistors. In the pixel 410, a source line Dx (x is a natural number, $1 \le x \le m$) and a gate line Gy (y is a natural number, $1 \le y \le n$) are provided so as to cross each other through an insulating layer. The pixel 410 has an EL element 405, a capacitor 407, a switching transistor 406 and a driving transistor 404. The switching transistor 406 controls an input of a video signal, and the driving transistor 404 controls light emission and non-light emission of the EL element 405. These transistors are field effect transistors, and for example, a thin film transistor can be used.

A gate of the switching transistor 406 is connected to the gate line Gy, one of a source electrode and a drain thereof is connected to the source line Dx, and the other thereof is connected to a gate of the driving transistor 404. One of a source and a drain of the driving transistor 404 is connected to a second power supply line 421 through a power supply line Vx (x is a natural number, $1 \le x \le m$), and the other thereof is connected to the EL element 405. One terminal of the EL element 405 is connected to a first power supply line 420, and the other terminal thereof is connected to one of the source and the drain of the driving transistor 404.

The capacitor 407 is provided between one of the source and the drain of the driving transistor 404 and the gate thereof.

As the switching transistor 406 and the driving transistor 404, an n channel type or a p channel type can be selected. The pixel 410 shown in FIG. 19 shows a case where the switching transistor 406 is an n channel type and the driving transistor 404 is a p channel type. A potential of the first power supply line 420 and a potential of the second power supply line 421 are not limited particularly. In order that a forward voltage or a reverse voltage is applied to the EL element 405, two electrode terminals of the EL element 405 are set at different potentials each other.

Color display can be performed by different luminous colors of the EL element 405 in such the pixel 410. The luminous color may be used with a combination of four colors added with emerald green as well as with a combination of three colors of red, green, and blue. Moreover, vermilion may also be added. In this manner, color reproduction properties can be improved by increasing the luminous color. In addition, a pixel performing a white display may also be combined; thereby image quality can be improved.

Figure 20:
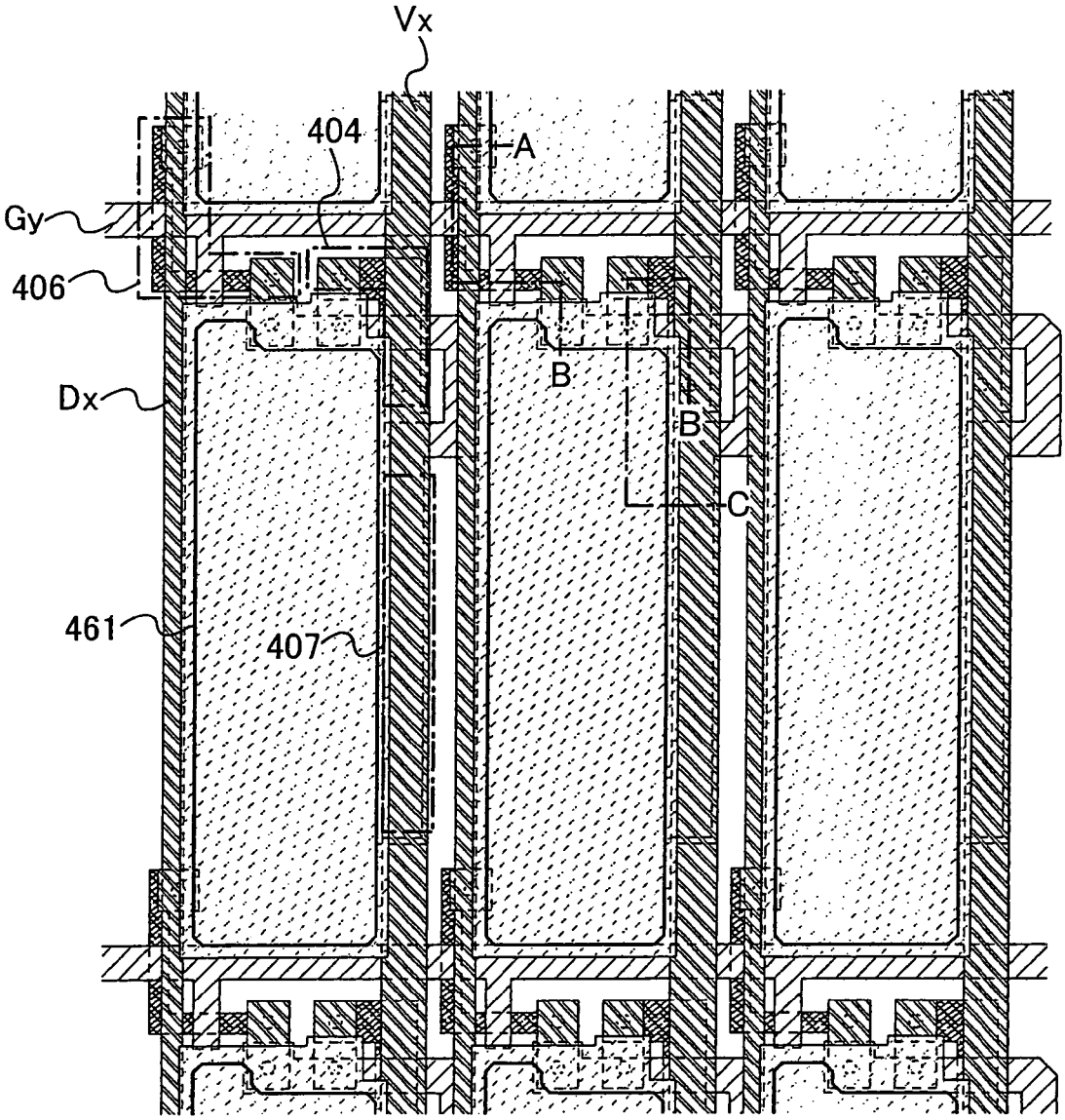
FIG. 20 is a plan view which shows one example of the pixel applicable to a display of the invention.

A plan view of such the pixel 410 is shown in FIG. 20. The switching transistor 406, the driving transistor 404 and the capacitor 407 are arranged. A first electrode 461 is one electrode of the EL element 405, and a light-emitting layer is stacked thereover to form the EL element 405 connected to the driving transistor 404. In order to increase an aperture ratio, the capacitor 407 is provided so as to overlap the power supply line Vx.

Figure 21:
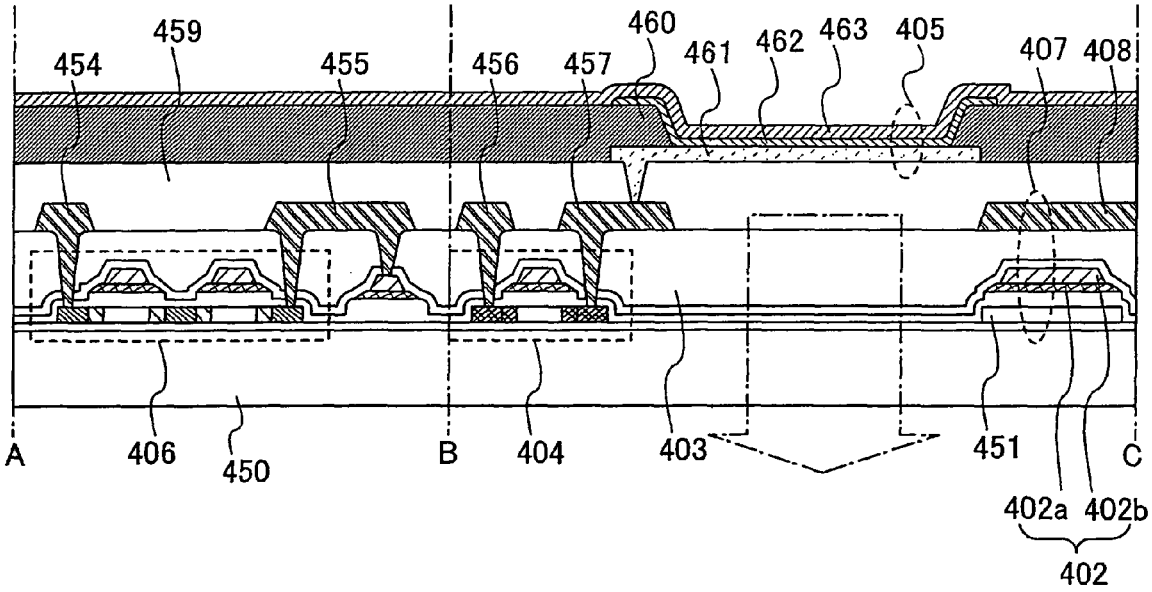
FIG. 21 is a cross-sectional view which shows one example of the pixel applicable to a display of the invention.

Further, a cross sectional structure corresponding to that cut along a line A-B-C shown in FIG. 20 is shown in FIG. 21. The switching transistor 406, the driving transistor 404, the EL element 405, and the capacitor 407 are provided over a substrate 450 having an insulating surface such as glass or quartz. It is preferable that the switching transistor 406 has a multiple gate in order to reduce an off current. Various semiconductors can be applied to a semiconductor forming channel portions of the switching transistor 406 and the driving transistor 404. For example, an amorphous semiconductor mainly composed of silicon, a semi-amorphous semiconductor (also called a microcrystalline semiconductor) or a polycrystalline semiconductor can be used. In addition, an organic semiconductor can be used as well. The semi-amorphous semiconductor is formed using silane gas ($SiH_4$) and fluorine gas ($F_2$), or formed using silane gas and hydrogen gas. Moreover, a polycrystalline semiconductor in which an amorphous semiconductor formed by a physical film formation method or a chemical film formation method such as a sputtering method or a vapor growth method is crystallized by irradiation of electromagnetic energy such as laser beam can be used. The gates of the switching transistor 406 and the driving transistor 404 may adopt a stacked structure of tungsten (W) and tungsten nitride (WN), a structure stacked molybdenum (Mo), aluminum (Al) and molybdenum (Mo) in this order from the top, or a stacked structure of molybdenum (Mo) and molybdenum nitride (MoN).

Wirings 454, 455, 456, and 457 connected to the sources or the drains of the switching transistor 406 and the driving transistor 404 are formed of a single layer or a stacked layer with a conductive material. For example, there is a stacked layer structure of titanium (Ti), aluminum silicon (Al—Si) and Ti, of Mo, Al—Si and Mo, or of MoN, Al—Si and MoN. These wirings 454, 455, 456, and 457 are formed over a first insulating layer 403.

The EL element 405 has a stacked layer structure of the first electrode 461 corresponding to a pixel electrode, a light-emitting layer 462, and a second electrode 463 corresponding to a counter electrode. An end portion of the first electrode 461 is surrounded by a barrier layer 460. The light-emitting layer 462 and the second electrode 463 are stacked so as to overlap with the first electrode 461 in an opening of the barrier layer 460. This overlapping portion becomes the EL element 405. In a case where both of the first electrode 461 and the second electrode 463 have light transmitting property, the EL element 405 emits light in a direction to the first electrode 461 and a direction to the second electrode 463. That is, the EL element 405 has a structure to emit light to both the directions. Moreover, in a case where one of the first electrode 461 and the second electrode 463 has light transmitting property and the other thereof has light blocking property, the EL element 405 emits light in either of the direction to the first electrode 461 or the direction to the second electrode 463. That is, the EL element 405 performs top emission or bottom emission.

FIG. 21 shows an example of a cross sectional structure in a case where the EL element 405 performs bottom emission. The capacitor 407 is arranged between the gate and the source of the driving transistor 404 and the gate-source voltage is held. The capacitor 407 forms capacitance by a semiconductor layer 451 provided in the same layer as a semiconductor layer forming the switching transistor 406 and the driving transistor 404, conductive layers 402*a* and 402*b* (hereinafter referred to as a conductive layer 402 collectively) provided in the same layer as the gates of the switching transistor 406 and the driving transistor 404, and an insulating layer interposed therebetween.

Moreover, the capacitor 407 forms capacitance by the conductive layer 402 provided in the same layer as the gates of the switching transistor 406 and the driving transistor 404, a wiring 458 provided in the same layer as the wirings 454, 455, 456, and 457 connected to the sources and the drains of the switching transistor 406 and the driving transistor 404, and an insulating layer interposed therebetween. Accordingly, the capacitor 407 can be obtained enough capacitance to hold the gate-source voltage of the driving transistor 404. Moreover, by forming the conductive layer configuring the power supply line so as to overlap, the decrease of the aperture ratio by arrangement of the capacitor 407 is suppressed.

Thicknesses of the wirings 454, 455, 456, 457, and 458 connected to the sources or the drains of the switching transistor 406 and the driving transistor 404 may be set to be 500 to 2000 nm, and preferably 500 to 1300 nm. Since the wirings 454, 455, 456, 457, and 458 form the source line Dx and the power supply line Vx, as the aforementioned characteristics, film thicknesses of the wirings 454, 455, 456, 457, and 458 are thickened so that effect by a voltage drop can be suppressed.

The first insulating layer 403 and a second insulating layer 459 may be formed using an inorganic material such as silicon oxide or silicone nitride, an organic material such as polyimide or acryl, or the like. The first insulating layer 403 and the second insulating layer 459 may be formed of the same material or may be formed of different materials each other. For the organic material, a material of siloxane-based, may be used, and for example, a material in which a skeleton is formed by the bond of silicon and oxygen and hydrogen is at least included as a substituent or a material in which a skeleton is formed by the bond of silicon and oxygen and one of fluorine, alkyl group, or aromatic hydrocarbon is at least included as a substituent, is used.

Such a structure of the pixel portion can be applied to the pixel portion 907 shown in FIG. 9 in Embodiment 1. Further, the structure of the pixel portion can be applied to a pixel portion of the display 1506 in FIG. 15 described in Embodiment 2, the display 1710 in FIG. 17 described in Embodiment 3, or the display of the cellular phone described in Embodiment 4.

A panel, which is one mode of a display device, mounting a pixel portion 411, a gate driver circuit 408 and a source driver circuit 409 is described. Over the substrate 450, the pixel portion 411 having a plurality of pixels including the EL element 405, the gate driver circuit 408, the source driver circuit 409 and a connection film 467 are provided (see FIG. 22 (A)). The connection film 467 is connected to an external circuit.

Figure 22:
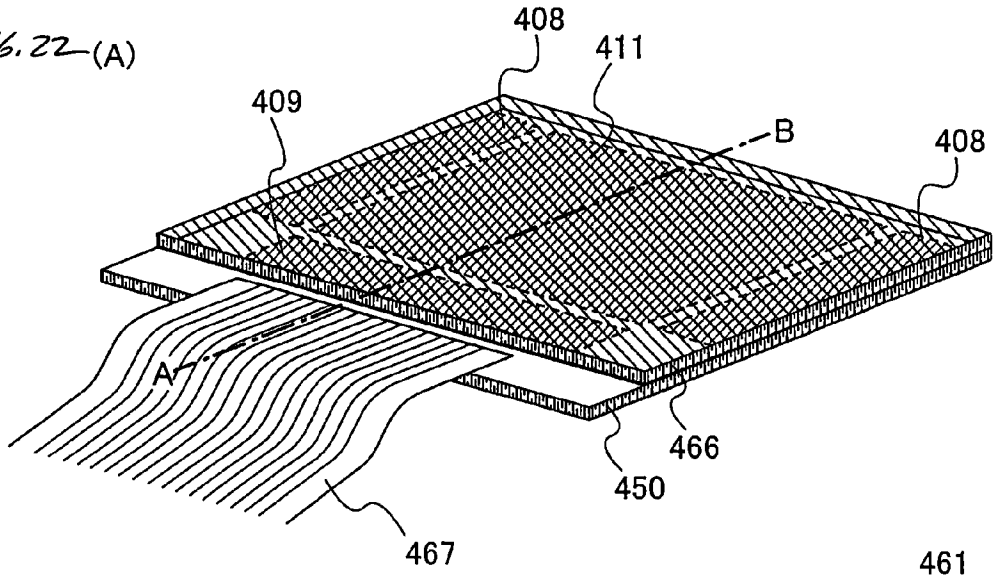
FIGS. 22(A)-22(B) are diagrams each of which shows a structure of a panel related to the invention.
Figure 22:
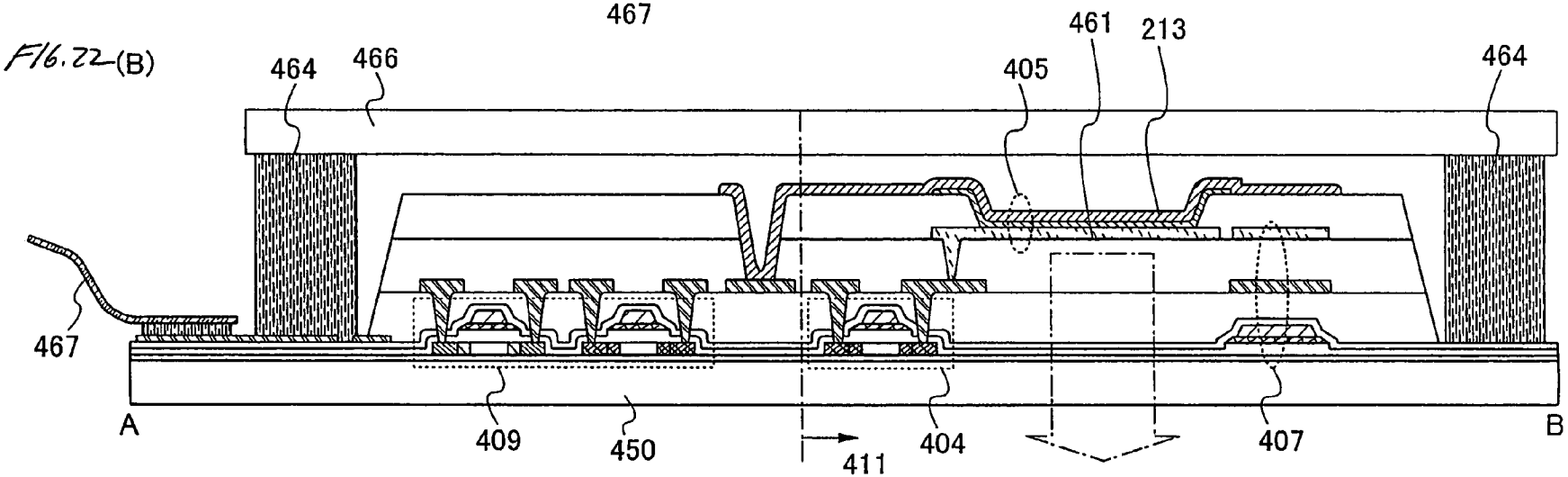

FIG. 22 (B) shows a cross-sectional view in A-B of the panel of FIG. 22 (A), and the driving transistor 404, the EL element 405 and the capacitor 407 provided in the pixel portion 411, and a transistor provided in the source driver circuit 409 are shown. A sealing material 464 is provided in the periphery of the pixel portion 411, the gate driver circuit 408 and the source driver circuit 409, and the EL element 405 is sealed by the sealing material 464 and a counter substrate 466. This sealing process is a process for protecting the EL element 405 from moisture, and although a method to seal by a cover material (glass, ceramic, plastic, metal or the like) is used here, a sealing method using a thermosetting resin or an ultraviolet curable resin, or a sealing method by a thin film with high barrier property such as metal oxide or nitride may be used. An element formed over the substrate 450 is preferred to be formed with a crystalline semiconductor (polysilicon) of which characteristics such as mobility is good compared with an amorphous semiconductor, so that to be monolithic is realized over the same surface. A panel having the aforementioned structure decreases the number of connecting external ICs so that miniaturization, light-weight and thin design are realized.

Figure 23:
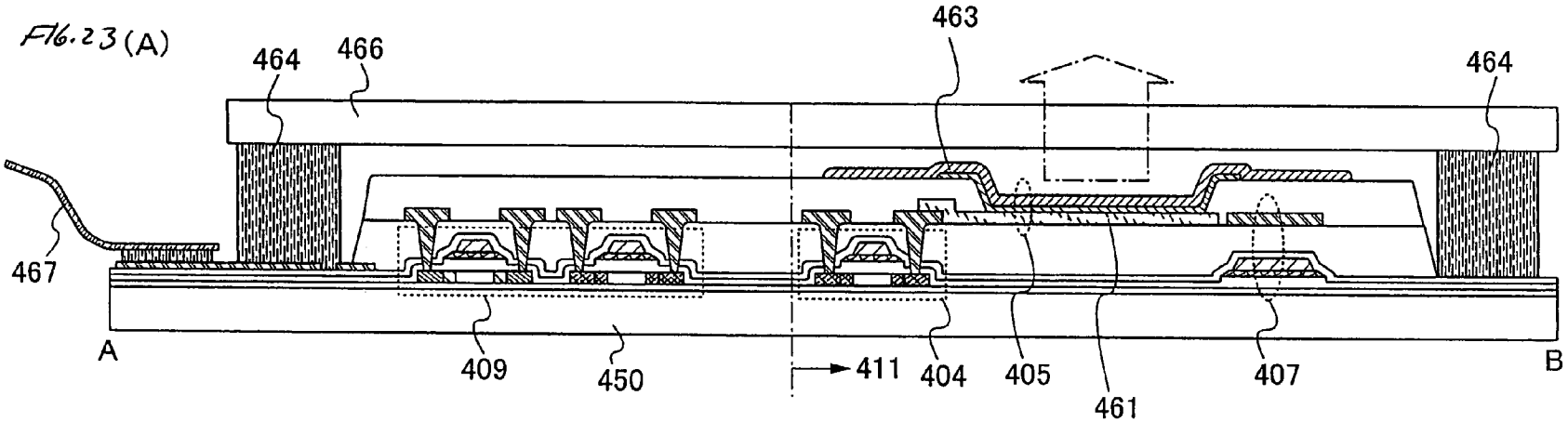
FIGS. 23(A)-23(B) are diagrams each of which shows a structure of a panel related to the invention.
Figure 23:
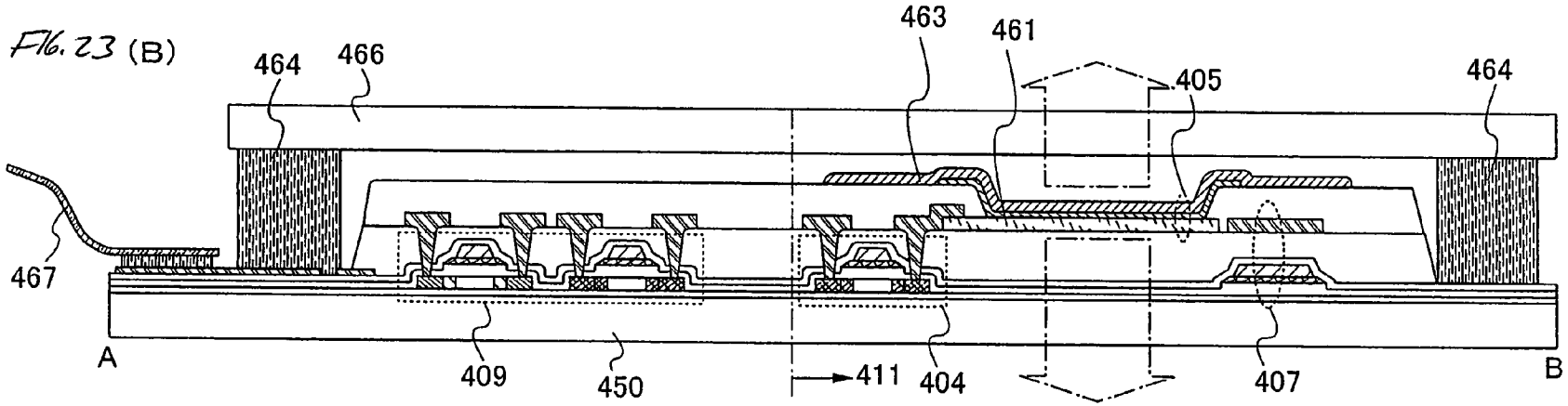

Note that in the structure shown in FIG. 22, the first electrode 461 of the EL element 405 has light transmitting property while the second electrode 463 has light blocking property. Therefore, the EL element 405 emits light to the substrate 450 side. As shown in FIG. 23 (A), as a structure which is different from the above, a structure can be made in which the first electrode 461 of the EL element 405 has light blocking property while the second electrode 463 has light transmitting property. In that case, the EL element 405 performs top emission. Moreover, as shown in FIG. 23 (B), as a structure which is different from the above, a structure can be made in which both of the first electrode 461 of the EL element 405 and the second electrode 463 are light transmitting electrodes to emit light from both surfaces.

Note that the pixel portion 411 may be formed of a transistor over an insulating surface in which an amorphous semiconductor (amorphous silicon) is a channel portion, and the gate driver circuit 408 and the source driver circuit 409 may be formed of a driver IC. The driver IC may be mounted on the substrate 450 by a COG method or may be mounted on the connection film 467 connected to the substrate 450. The amorphous semiconductor can be easily formed over a large area substrate by using a CVD method and a step of crystallization is not required; therefore, an inexpensive panel can be provided. Moreover, at this time, when a conductive layer is formed by a droplet-discharging method typified by ink-jet printing, a more inexpensive panel can be provided.

Such a structure of the pixel portion can be applied to the pixel portion 907 shown in FIG. 9 in Embodiment 1. Further, the structure of the pixel portion can be applied to a pixel portion of the display 1506 in FIG. 15 described in Embodiment 2, the display 1710 in FIG. 17 described in Embodiment 3, or the display of the cellular phone described in Embodiment 4.

Figure 24A:
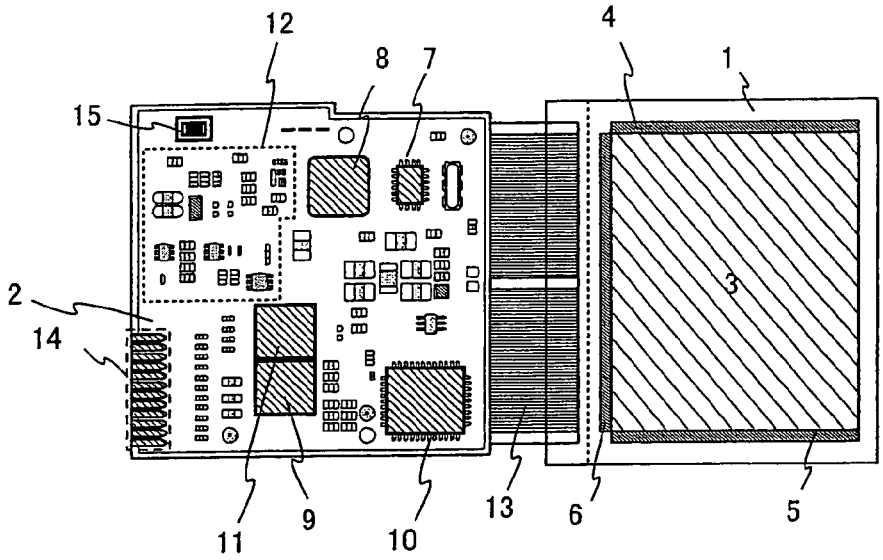
FIGS. 24(A)-24 (B) are diagrams each of which shows a structure example of a module related to the invention.
Figure 24B:
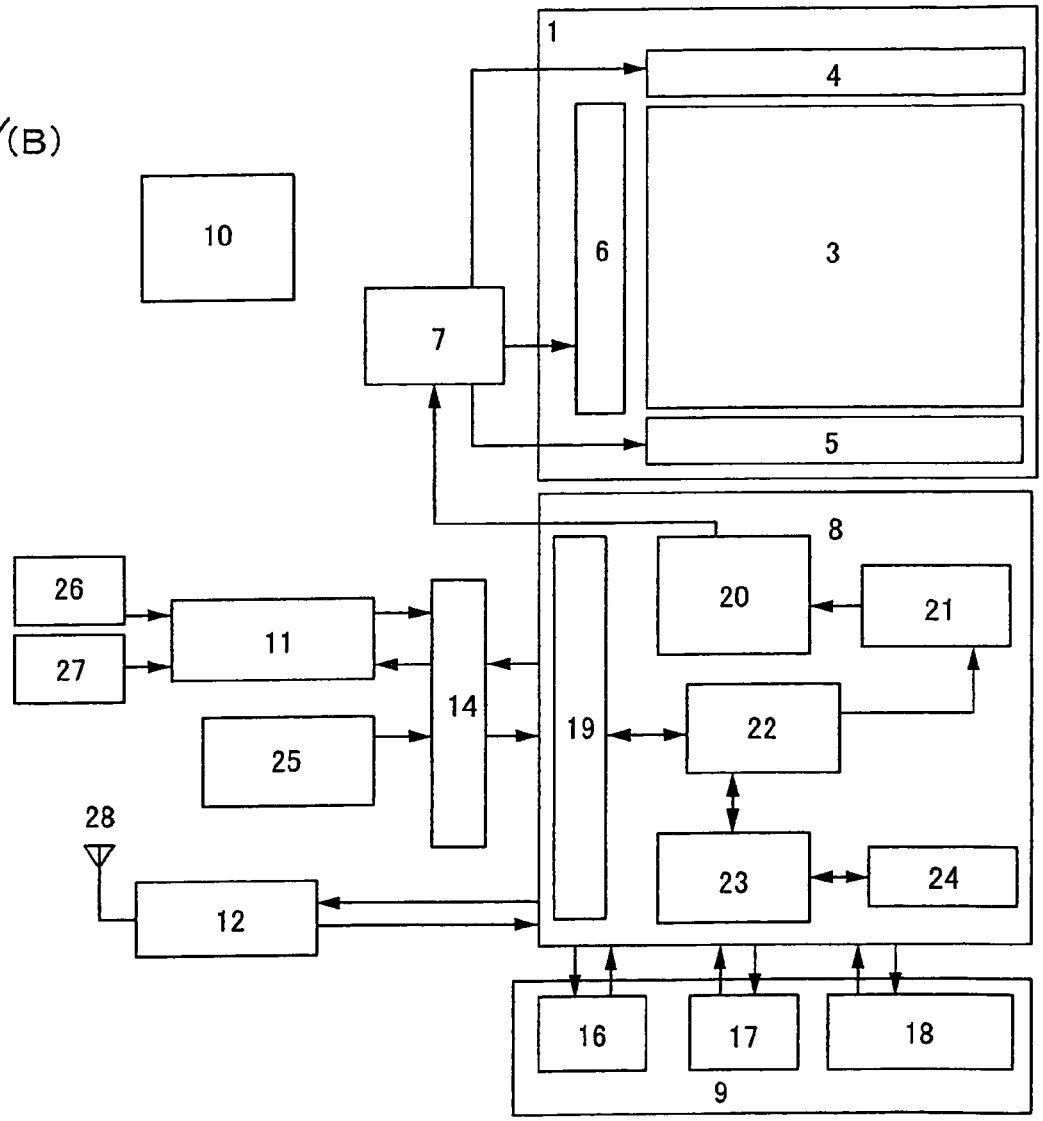

FIG. 24 (A) shows a module combined with a panel 1 and a printed circuit board 2. The panel 1 has a pixel portion 3 in which an EL element is provided in each pixel, a first gate driver circuit 4, a second gate driver circuit 5, and a source driver circuit 6 for supplying a video signal to a selected pixel. This configuration is similar to that of Embodiment 1.

To the printed circuit board 2, a display controller 7, a central processing unit (CPU) 8, a memory 9, a power supply circuit 10, an audio processing circuit 11, a transmitter/receiver circuit 12 and the like are provided. A function of the display controller 7 is similar to that of Embodiment 2. The printed circuit board 2 and the panel 1 are connected each other by a flexible printed circuit (FPC) 13. The printed circuit 13 may be formed to have a structure in which a capacitor, a buffer circuit, and the like are provided to prevent noise generation in a power supply voltage or a signal or delay of the rising of a signal. Moreover, the controller 7, the audio processing circuit 11, the memory 9, the CPU 8, the power supply circuit 10, and the like can be mounted on the panel 1 using a COG (Chip on Glass) method. By a COG method, the size of the printed circuit board 2 can be reduced.

Through an interface portion 14 (I/F portion 14) provided on the printed circuit board 2, an input/output of various control signals of an input means 25 such as a key switch or a stylus pen is performed. Moreover, an antenna port 15 for transmitting/receiving a signal to/from an antenna is provided on the printed circuit board 2.

FIG. 24 (B) shows a block diagram of the module shown in FIG. 24 (A). This module includes a VRAM 16, a DRAM 17, a flash memory 18 and the like as the memory 9. Image data to be displayed on the panel is stored in the VRAM 16, image data or audio data is stored in the DRAM 17, and various programs are stored in the flash memory.

The power supply circuit 10 supplies a power to operate the panel 1, the display controller 7, the CPU 8, the audio processing circuit 11, the memory 9, and the transmitter/receiver circuit 12. Further, depending on a panel specification, there is a case where a current source may be provided to the power supply circuit 10.

The CPU 8 has a control signal generating circuit 20, a decoder 21, a register 22, an arithmetic circuit 23, a RAM 24, an interface 19 for the CPU 8, and the like. Various signals inputted to the CPU 8 through the interface 19 are once held in the register 22, and then inputted to the arithmetic circuit 23, the decoder 21 and the like. An arithmetic operation is performed based on the inputted signal in the arithmetic circuit 23, and an address to which various instructions are transmitted is specified. On the other hand, the signal inputted to the decoder 21 is decoded and inputted to the control signal generating circuit 20. The control signal generating circuit 20 generates a signal including various instructions based on the inputted signal, and transmits to the address specified by the arithmetic circuit 23, specifically the memory 9, the transmitter/receiver circuit 12, the audio processing circuit 11, the display controller 7 or the like.

A signal transmitted/received as an electromagnetic wave in an antenna 28 is processed in the transmitter/receiver circuit 12, and specifically, a high frequency circuit such as an isolator, a bandpass filter, a VCO (Voltage Controlled Oscillator), an LPF (Low Pass Filter), a coupler, or a balun is included. A signal including audio information among the signals transmitted/received to/from the transmitter/receiver circuit 12 is transmitted to the audio processing circuit 11 in accordance with instruction from the CPU 8.

The signal including the audio information transmitted in accordance with the instruction of the CPU 8 is demodulated to an audio signal in the audio processing circuit 11 to be transmitted to a speaker 27. Moreover, an audio signal transmitted from a microphone 26 is modulated in the audio processing circuit 11 to be transmitted to the transmitter/receiver circuit 12 in accordance with the instruction from the CPU 8.

The display controller 7, the CPU 8, the power supply circuit 10, the audio processing circuit 11, and the memory 9 can be mounted as a package of this embodiment. This embodiment can be applied to any kind of circuit except for the high frequency circuit such as the isolator, the bandpass filter, the VCO (Voltage Controlled Oscillator), the LPF (Low Pass Filter), the coupler, or the balun.

A display controller is provided; thereby the module of this embodiment can change a subframe structure for each row to display a display. Accordingly, in a row where all gradations are not required for gradation to be displayed, the number of subframes forming one frame can be reduced. Accordingly, in the display device of the invention, since the number of writings to a pixel can be reduced, low power consumption can be suppressed. Furthermore, since the subframe structure can be changed for each row, the most suitable subframe structure is used so that generation of a moving image pseudo contour can be suppressed.

Embodiment 8

This embodiment describes one example to complete a mobile phone device 90 with the panel described in Embodiment 7.

Figure 25:
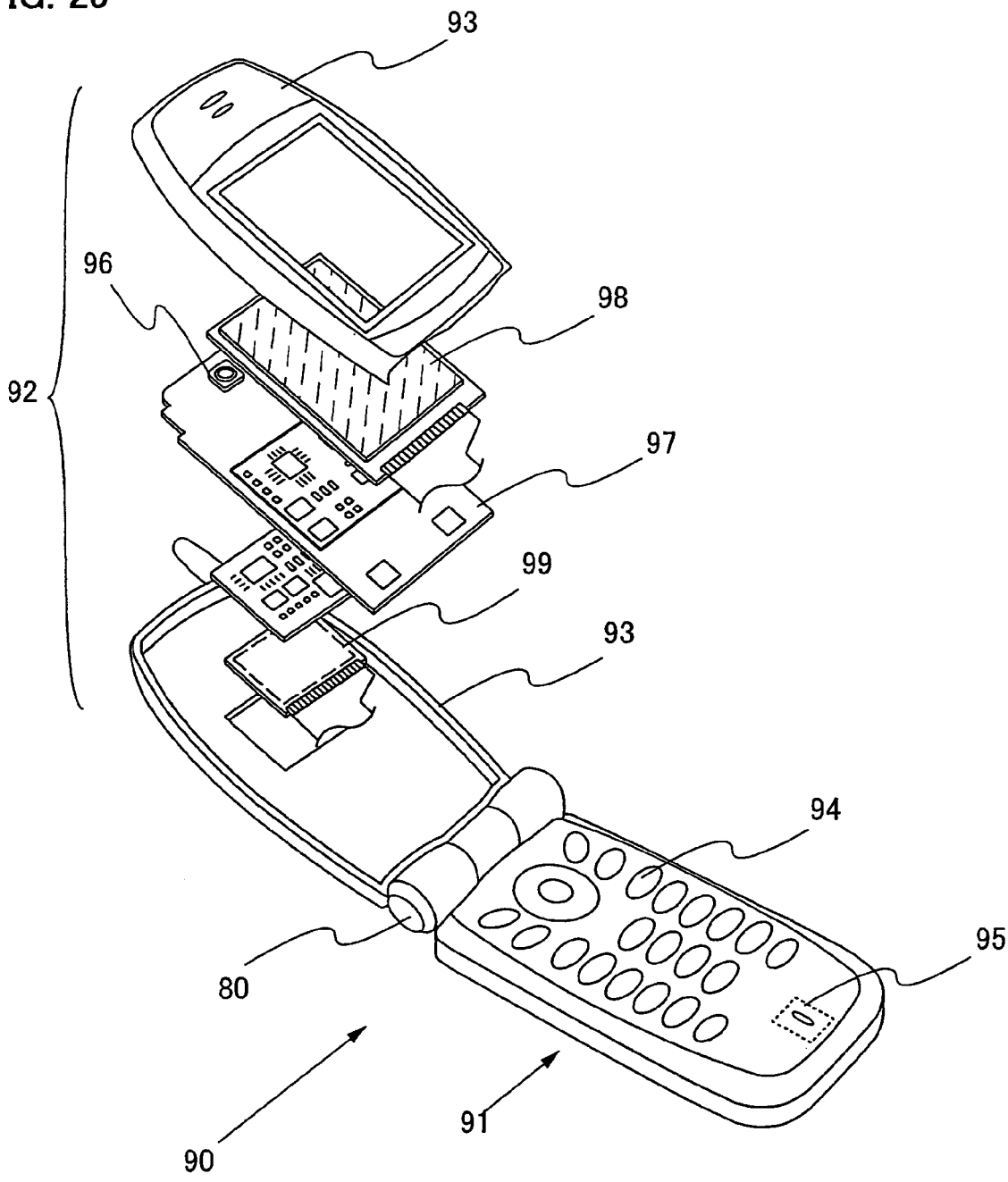
FIG. 25 is a diagram which shows a structure example of a mobile phone device related to the invention.

In the mobile phone device shown in FIG. 25, a main body (A) 91 provided with an operating switch 94, a microphone 95 and the like, and a main body (B) 92 provided with a panel (A) 98, a panel (B) 99, a speaker 96 and the like are connected with a hinge 80 so as to be capable of opening and closing. The panel (A) 98 and the panel (B) 99 are housed in a housing 93 of the main body (B) 92 in addition to a circuit board 97. Pixel portions of the panel (A) 98 and the panel (B) 99 are arranged to be visible from an opening window formed in the housing 93.

In the panel (A) 98 and the panel (B) 99, a specification such as the number of pixels can be appropriately set in accordance with a function of the mobile phone device 90. For example, the panel (A) 98 as a main display and the panel (B) 99 as a sub display can be combined with each other.

The panel (A) 98 can be made to be a color display screen with high definition for displaying text or an image, and the panel (B) 99 can be made to be a monochrome information display screen for displaying text information. Particularly, if the panel (B) 99 is as an active matrix type to realize high definition, various text information is displayed so that information display density per one screen can be improved. For example, in the case where the panel (A) 98 is formed to be a QVGA (320 dots×240 dots) of 64 gradation and 260,000 colors at 2 to 2.5 inches, and the panel (B) 99 is formed to be a high-definition panel of 2 to 8 gradation, monochrome, and 180 to 220 ppi, a Chinese character, an Arabic alphabet, or the like as well as a Roman character, a hiragana, a katakana can be displayed.

Low power consumption can be achieved by mounting the module described in Embodiment 7 on the mobile phone device. Moreover, generation of a moving image pseudo contour can be suppressed. Accordingly, in the case where a tuner is incorporated in the module to receive digital terrestrial broadcasting, a moving image can be appreciated for a long time and image quality can be improved.

The mobile phone device related to this embodiment can be changed in various modes in accordance with the function and application. For example, an image sensor may be incorporated in a portion of the hinge 80 to be a mobile phone device with a camera. Moreover, even in the case of a structure in which the operating switch 94, the display panel (A) 98, and the display panel (B) 99 are incorporated in one housing, the aforementioned operation effect can be obtained. Further, even when the structure of this embodiment is applied to an information display terminal provided with a plurality of display portions, a similar effect can be obtained.

Embodiment 9

Figure 26:
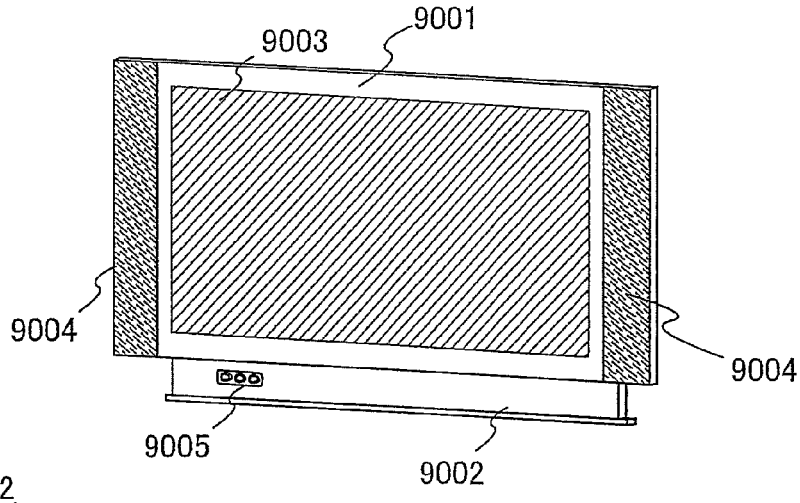
FIGS. 26(A)-26(C) are views each of which shows one example of an electronic apparatus related to the invention.
Figure 26:
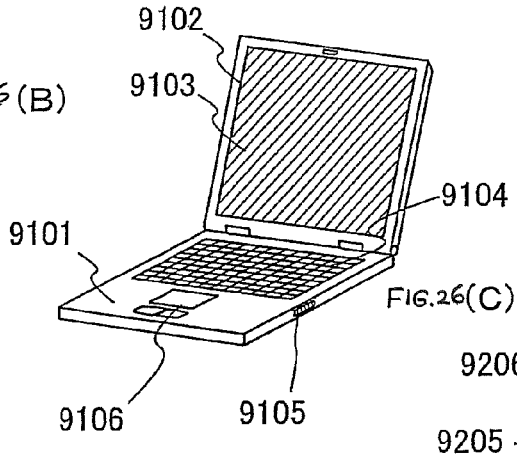
Figure 26:
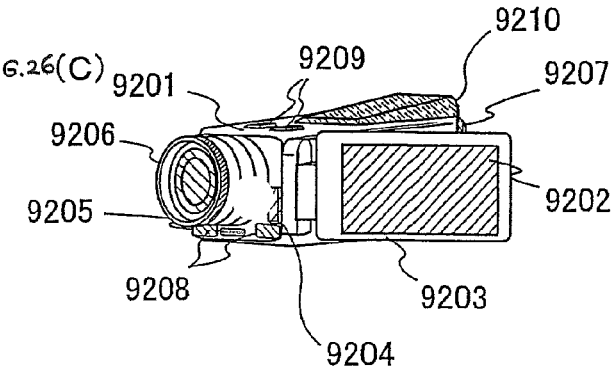
Figure 27A:
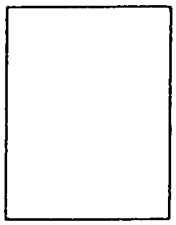
FIGS. 27(A)-27(G) are diagrams each of which shows a proportion of power consumption depending on a pattern, related to the invention.
Figure 27B:
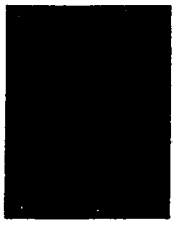
Figure 27C:
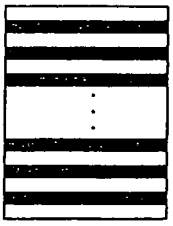
Figure 27D:
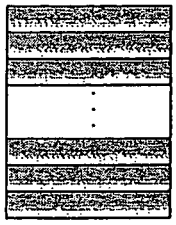
Figure 27E:
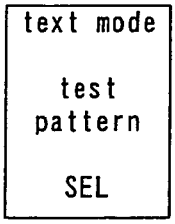
Figure 27F:
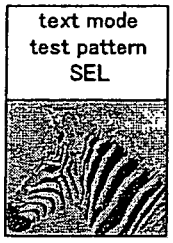
Figure 27G:
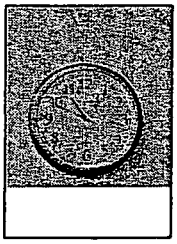

This embodiment describes an electronic apparatus completed by the invention with reference to FIG. 26.

As an electronic apparatus manufactured using the display device described in Embodiments 1 to 4, there are a television, a video camera, a digital camera, a goggle type display (a head-mounted display), a navigation system, an audio reproducing device (a car audio, an audio component, or the like), a personal computer, a game machine, a portable information terminal (a mobile computer, a portable game machine, an electronic book, or the like), an image reproducing device provided with a recording medium (specifically a device provided with a display device in which a recording medium such as a digital video disk (DVD) is reproduced and the image can be displayed), lighting equipment, or the like. Specific examples of these electronic apparatuses are shown in FIG. 26.

FIG. 26 (A) is a television device including a housing 9001, a support base 9002, a display portion 9003, a speaker portion 9004, a video input terminal 9005 and the like. Since the display portion 9003 is composed of a panel formed by using the invention and the number of subframes composing one frame can be reduced, power consumption can be suppressed. Moreover, the most suitable subframe structure is used so that generation of a moving image pseudo contour can be suppressed.

FIG. 26 (B) is a computer including a main body 9101, a housing 9102, a display portion 9103, a keyboard 9104, an external connection port 9105, a pointing mouse 9106 and the like. Since the display portion 9103 is composed of a panel formed by using the invention and the number of subframes composing one frame can be reduced, power consumption can be suppressed. Moreover, the most suitable subframe structure is used so that generation of a moving image pseudo contour can be suppressed.

FIG. 26 (C) is a video camera including a main body 9201, a display portion 9202, a housing 9203, an external connection port 9204, a remote control receiving portion 9205, an image receiving portion 9206, a battery 9207, a sound input portion 9208, operation keys 9209, an eyepiece portion 9210 and the like. Since the display portion 9202 is composed of a panel formed by using the invention and the number of subframes composing one frame can be reduced, power consumption can be suppressed. Moreover, the most suitable subframe structure is used so that generation of a moving image pseudo contour can be suppressed.

As set forth above, an electronic apparatus or lighting equipment in which the EL element of the invention is used can be obtained. The scope of application of the display device having the EL element of the invention is extremely wide, and this display device can be applied to electronic apparatuses of any field.

The invention claimed is:

1. A display device comprising:

a pixel portion including a plurality of pixels arranged in rows, the display device being configured to input m-bits digital signals into corresponding pixels of a row of pixels, m being a natural number;

a shift register configured to output a plurality of pulse signals;

a plurality of gate signal lines configured to be inputted with the pulse signals and connected to the plurality of pixels; and a write enable circuit connected between the shift register and the plurality of gate signal lines and configured to permit or prohibit inputting the plurality of pulse signals into the plurality of gate signal lines in accordance with a number p of bits among the m-bits of the digital signals which have a same order and a same value for all the pixels of the row of pixels, p being an integer equal to or greater than 2 and equal to or lower than m.

2. A display device according to claim 1, wherein the display device is configured to perform time gradation display using n subframes;

wherein n is a natural number;

wherein m and n are defined in accordance with a number of subframes and a number of gradations to be displayed for each row of pixel row; and wherein, m can be inferior to, equal to, or greater than n.

3. A display device comprising:

a pixel portion having a first row including a plurality of first pixels and a second row including a plurality of second pixels;

a shift register configured to output pulse signals;

gate signal lines connected to the first pixels and to the second pixels, and configured to be inputted with the pulse signals; and a write enable circuit connected between the shift register and the gate signal lines, the write enable circuit being configured to allow or prohibit writing of the pulse signals from the shift register to the gate signal lines in accordance with a number of subframe periods to be displayed in a row of pixel, wherein the display device is configured to input a first m-bits digital signal to the first row, and to input a second m-bits digital signal to the second row;

wherein a number p of bits among the m-bits of the first digital signals have a same order and a same value for all the pixels of the first row, p being an integer equal to or greater than 1 and equal to or lower than m;

wherein a number q of bits among the m-bits of the second digital signals have a same order and a same value for all the pixels of the second row, q being an integer equal to or greater than 1, equal to or lower than m, and different from p; and wherein the number of subframes to be displayed and the number of gradation capable of being displayed depend on the number p of bits for the first row, on the number q of bits for the second row, and is different for the first row and for the second row.

4. The display device according to claim 1, further comprising:

a first memory circuit;

a second memory circuit; and a circuit configured to conduct a control for inputting digital signals to any of the first memory circuit and the second memory circuit.

5. The display device according to claim 2, comprising:

a first memory circuit;

a second memory circuit; and a circuit configured to conduct a control for inputting the digital signals to any of the first memory circuit and the second memory circuit.

6. The display device according to claim 4, comprising:

a circuit for inputting data of the same video bit of the digital signals into one address in the first memory circuit or the second memory circuit.

7. The display device according to claim 5, comprising:

a circuit for inputting data of the same video bit of the plurality of digital signals into one address in the first memory circuit or the second memory circuit.

8. The display device according to claim 4, comprising:

a circuit for inputting data of the same writing generation period of the plurality of pulse signals into one address in the first memory circuit or the second memory circuit.

9. The display device according to claim 5, comprising:

a circuit for inputting data of the same writing generation period of the plurality of digital signals into one address in the first memory circuit or the second memory circuit.

10. The display device according to claim 3, comprising:

a first memory circuit;

a second memory circuit; and a circuit configured to conduct a control for inputting the digital signals to any of the first memory circuit or the second memory circuit.

11. The display device according to claim 10, comprising:

a circuit for inputting data of the same video bit of the first digital signal and the second digital signal into one address in the first memory circuit or the second memory circuit.

12. The display device according to claim 10, comprising:

a circuit for inputting data of the same writing generation period of the first digital signal and the second digital signal into one address in the first memory circuit or the second memory circuit.

13. A display device comprising:

a pixel portion having a first row including a plurality of first pixels and a second row including a plurality of second pixels;

a shift register configured to output pulse signals;

gate signal lines connected to the first pixels and to the second pixels, and configured to be inputted with the pulse signals; and a write enable circuit connected between the shift register and the gate signal lines, the write enable circuit being configured to allow or prohibit writing of signals from the shift register to the signal gate lines according to a number of gradations to be displayed, row by row, wherein the display device is configured to input a first digital signal to the first row, the first digital signal having a first number of bits each having a same order and a same value for each pixel of the first row;

wherein the display device is configured to input a second digital signal to the second row, the second digital signal having a second number of bits each having a same order and a same value for each pixel of the second row, the second number being different from the first number; and wherein time gradation display is performed using numbers of gradations different from each other in the first row and the second row, and is performed by prohibiting or allowing writing of the signal pulses for the first digital signal and the second digital signal.

14. The display device according to claim 1, wherein the display device is able to provide more than one subframe corresponding to a certain bit of a video signal in one frame period, wherein the subframes are dispersed in the frame period.

15. The display device according to claim 1, wherein the number of the gradations capable of being displayed is in accordance with a condition in that a plurality of video bits are equivalent in order and in value for all video data written in each pixel for one row.

16. A display device according to claim 13, wherein at least one of the first digital signal and the second digital signal is an m-bit digital signal;

wherein the display device is configured to perform time gradation display using n subframes formed using the m-bit digital signal;

wherein m and n are natural numbers;

wherein m and n are defined in accordance with a number of subframes and a number of gradations to be displayed for each of the pixel rows; and wherein, m can be inferior to, equal to, or greater than n.

17. A display device according to claim 1, wherein the write enable circuit is configured to permit or prohibit inputting the plurality of pulse signals into the plurality of gate signal lines in accordance with a number-of gradations to be displayed in rows of pixels, independently for each row of pixels.

* * * * *